US010661136B2

(12) United States Patent
Onuki

(10) Patent No.: US 10,661,136 B2
(45) Date of Patent: May 26, 2020

(54) GOLF CLUB HEAD

(71) Applicant: Sumitomo Rubber Industries, Ltd., Kobe-shi, Hyogo (JP)

(72) Inventor: Masahide Onuki, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 16/418,603

(22) Filed: May 21, 2019

(65) Prior Publication Data

US 2019/0374831 A1 Dec. 12, 2019

(30) Foreign Application Priority Data

Jun. 11, 2018 (JP) ..... 2018-111314

(51) Int. Cl.

| | |
|---|---|
| ***A63B 53/04*** | (2015.01) |
| ***A63B 60/50*** | (2015.01) |
| ***A63B 60/52*** | (2015.01) |
| *A63B 102/32* | (2015.01) |
| *A63B 53/08* | (2015.01) |

(52) U.S. Cl.

CPC ..... *A63B 60/50* (2015.10); *A63B 53/0466* (2013.01); *A63B 60/52* (2015.10); *A63B 53/04* (2013.01); *A63B 53/08* (2013.01); *A63B 2053/042* (2013.01); *A63B 2053/045* (2013.01); *A63B 2053/0408* (2013.01); *A63B 2053/0416* (2013.01); *A63B 2053/0454* (2013.01); *A63B 2053/0458* (2013.01); *A63B 2102/32* (2015.10)

(58) Field of Classification Search

CPC ..... A63B 2053/0416; A63B 2053/042; A63B 2053/0425; A63B 2053/0429; A63B 2053/0458; A63B 53/04; A63B 53/0466; A63B 53/08; A63B 2053/0454; A63B 2053/045

USPC ..... 473/342, 345, 346, 350

See application file for complete search history.

(56) References Cited

U.S. PATENT DOCUMENTS 5,499,814 A * 3/1996 Lu ..... A63B 53/04 473/329
7,281,990 B2 * 10/2007 Hagood ..... A63B 53/04 473/329
2015/0273286 A1 10/2015 Onuki

* cited by examiner

*Primary Examiner* — Benjamin Layno

(74) *Attorney, Agent, or Firm* — Birch, Stewart, Kolasch & Birch, LLP

(57) ABSTRACT

A golf club head includes a head body, a face part located apart from the head body, and a plurality of connecting parts that extend between the head body and the face part. Each connecting part includes an inclination portion that extends while inclining with respect to a face perpendicular direction. The inclination portion may include a straight inclination portion that extends along a straight line. The inclination portion may include an arc inclination portion that extends along a circular arc. The inclination portion may include a first inclination portion and a second inclination portion that are inclined inversely to each other. The inclination portion can facilitate deformation of the connecting part at impact.

20 Claims, 30 Drawing Sheets

GOLF CLUB HEAD

The present application claims priority on Patent Application No. 2018-111314 filed in JAPAN on Jun. 11, 2018. The entire contents of this Japanese Patent Application are hereby incorporated by reference.

BACKGROUND OF THE INVENTION

Field of the Invention

The present disclosure relates to a golf club head.

Description of the Related Art

There has been proposed a head including a face part, a head body, and a connecting part that connects the face part and the head body, as a head having a good rebound performance.

SUMMARY OF THE INVENTION

The inventor of the present application has found that rebound performance can be further improved by using a new structure of the connecting part.

The present disclosure provides a golf club head that is excellent in rebound performance.

In one aspect, a golf club head includes a head body, a face part located apart from the head body, and a plurality of connecting parts that extend between the head body and the face part, the connecting parts each including an inclination portion that extends while inclining with respect to a face perpendicular direction.

DESCRIPTION OF THE PREFERRED EMBODIMENTS

The following will describe embodiments in detail with appropriate reference to the drawings.

Definitions of Terms

The following terms are defined in the present application.

[Reference State, Reference Perpendicular Plane]

Figure 30:
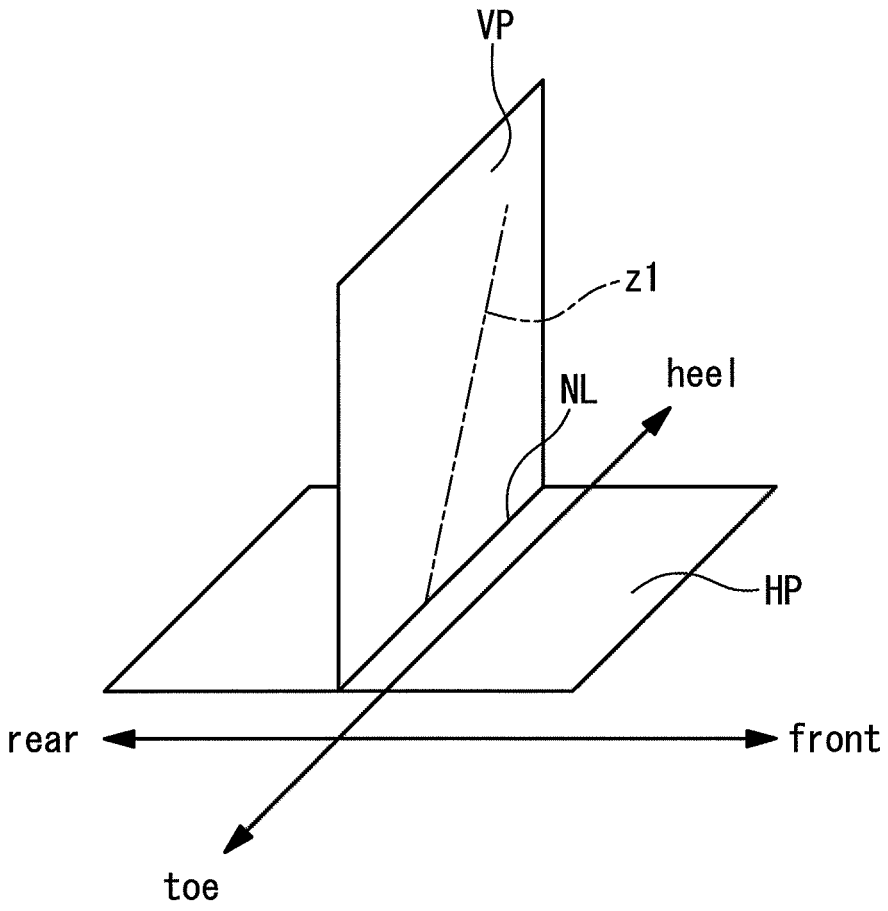
FIG. 30 is a schematic diagram showing a reference state.

A plane VP perpendicular to a horizontal plane HP is set (see FIG. 30). A state where a center axis line z1 of a shaft hole is included in the plane VP and a head is placed at a specified lie angle and real loft angle on the horizontal plane HP is defined as a reference state (see FIG. 30). The plane VP is defined as a reference perpendicular plane. The predetermined lie angle and real loft angle are described, for example, in a product catalogue.

[Toe-Heel Direction]

A toe-heel direction is a direction of an intersection line NL between the reference perpendicular plane VP and the horizontal plane HP (see FIG. 30).

[Front-Rear Direction]

A front-rear direction is a direction that is perpendicular to the toe-heel direction and parallel to the horizontal plane HP.

[Up-Down Direction]

An up-down direction is a direction that is perpendicular to the horizontal plane HP.

[Face Perpendicular Line]

A face perpendicular line is a normal line to a striking face (face surface). When the striking face is a curved surface, the orientation of the face perpendicular line varies depending on its location on the striking face.

[Face Perpendicular Direction]

A face perpendicular direction is the direction of the face perpendicular line. When the striking face is a curved surface, the direction of the face perpendicular line at a face center is defined as the face perpendicular direction.

[Face Projection Plane]

A face projection plane is a plane that is perpendicular to the face perpendicular direction.

[Planar Projection Image]

A projection image that is projected onto the face projection plane is defined as a planar projection image. In the projection onto the face projection plane, the direction of the projection is the face perpendicular direction.

[x-coordinate and y-coordinate on Striking Face]

An x-y coordinate system having its origin at the face center is defined in the planar projection image of the striking face. The x-axis of the x-y coordinate system is a straight line passing through the face center and parallel to an intersection line between the face projection plane and the horizontal plane HP. The y-axis of the x-y coordinate system is a straight line passing through the face center and perpendicular to the x-axis. The x-coordinate is a positive value on the heel side and a negative value on the toe side. The y-coordinate is a positive value on the upper side (top side) and a negative value on the lower side (sole side).

[Face Center]

Figure 6:
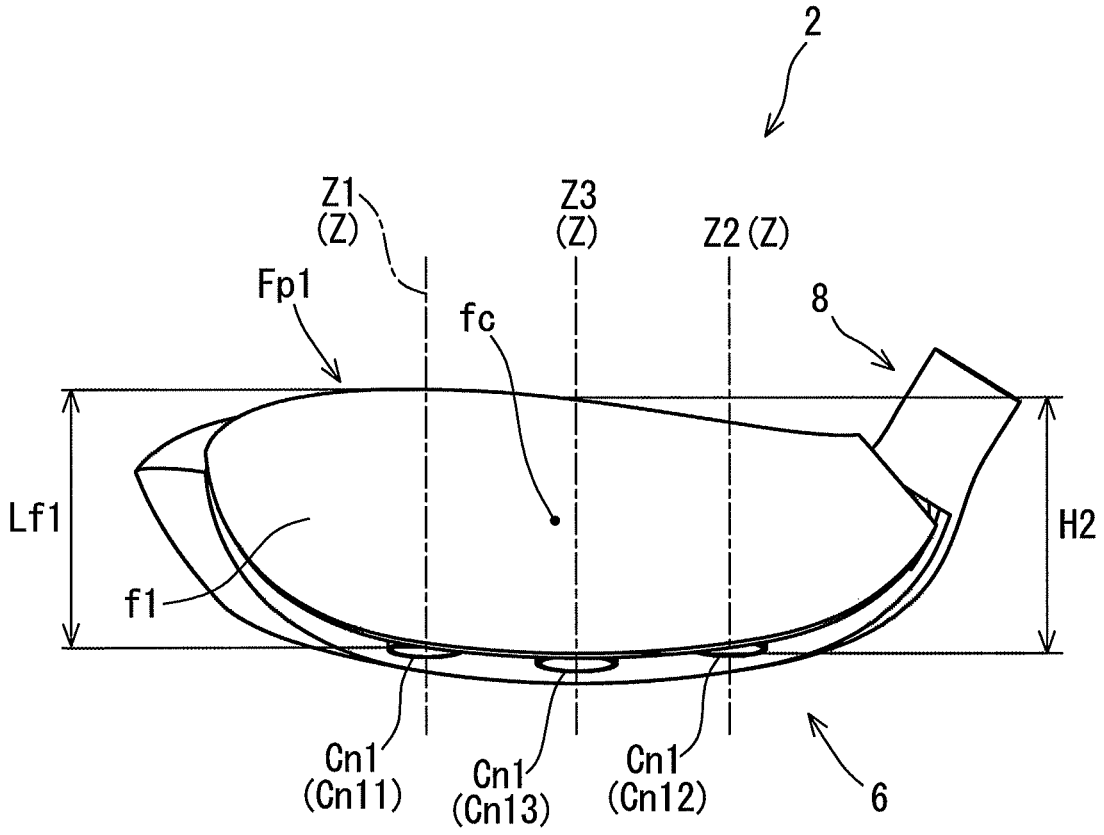
FIG. 6 is a front view of the head in FIG. 1.

A center of figure of the planar projection image of the striking face is defined as the face center. FIG. 6 described later shows a face center fc.

Figure 1:
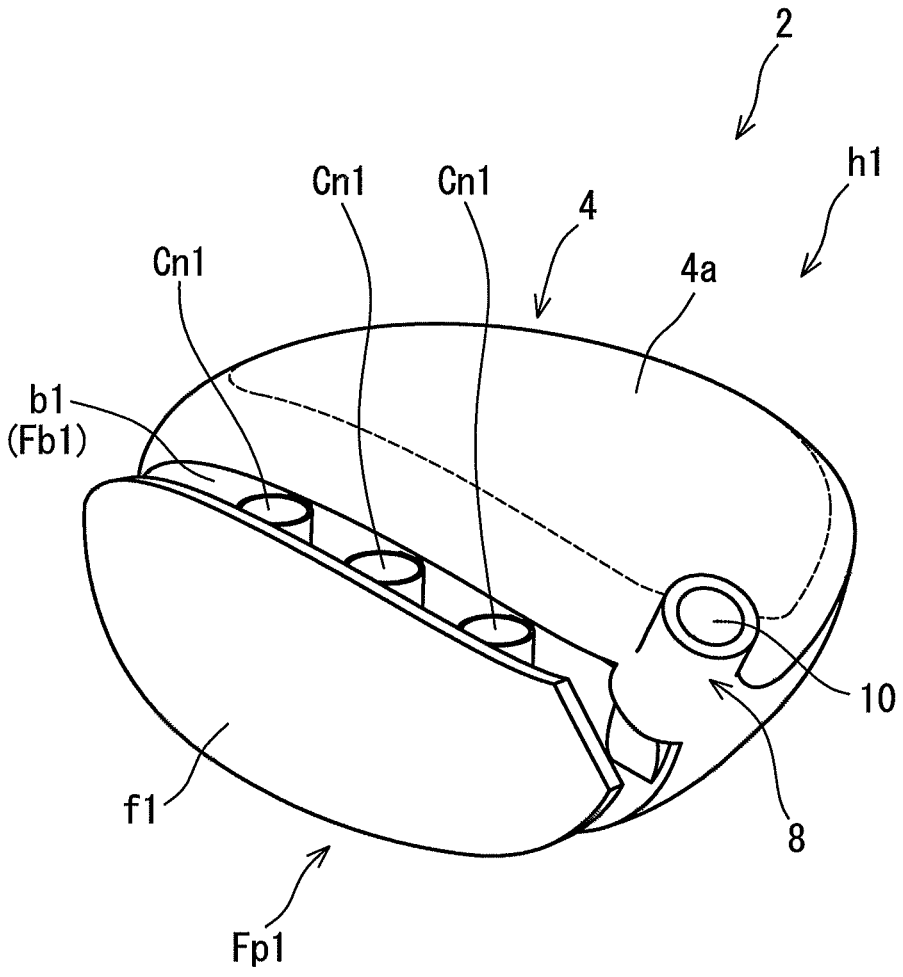
FIG. 1 is a perspective view of a golf club head according to a first embodiment.
Figure 2:
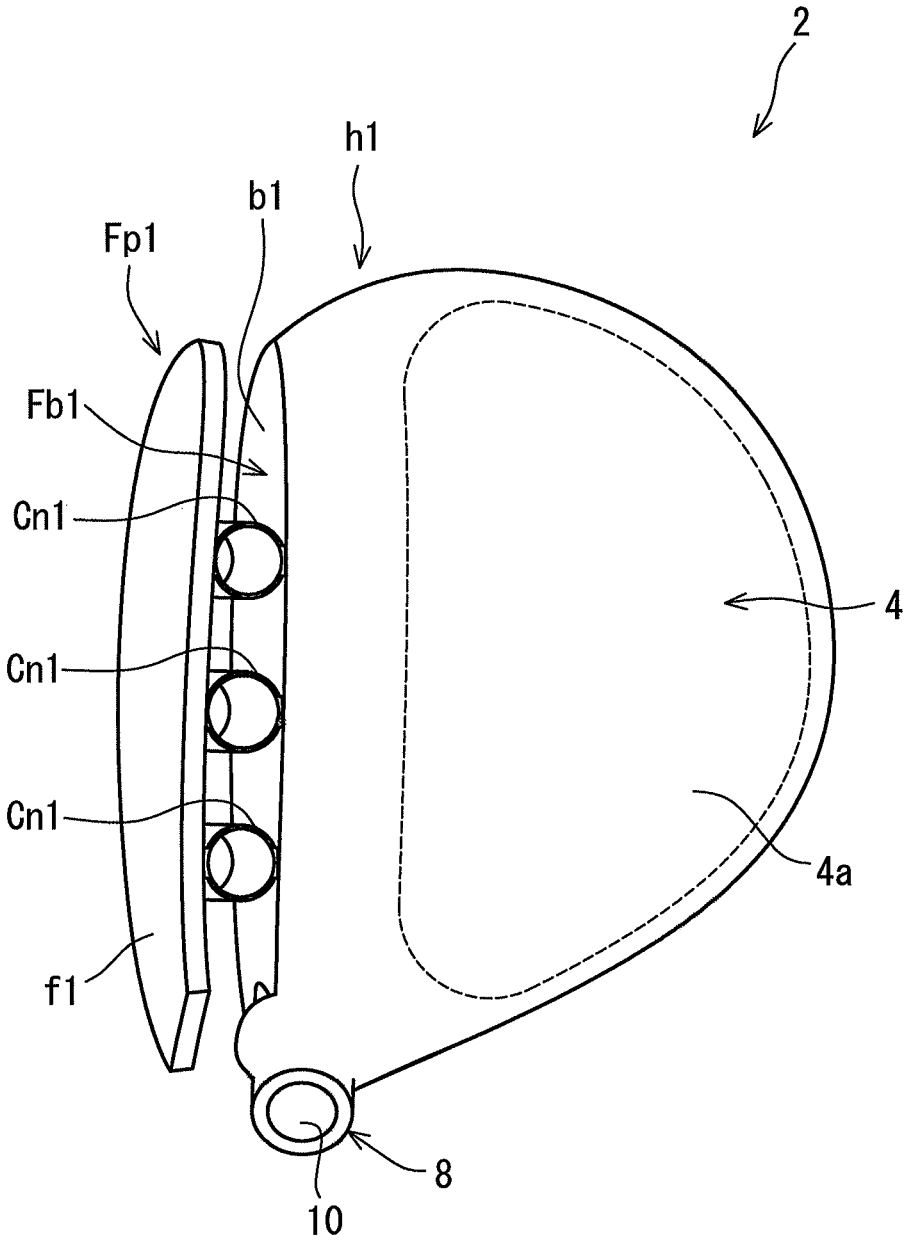
FIG. 2 is a plan view of the head in FIG. 1 as viewed from above.
Figure 3:
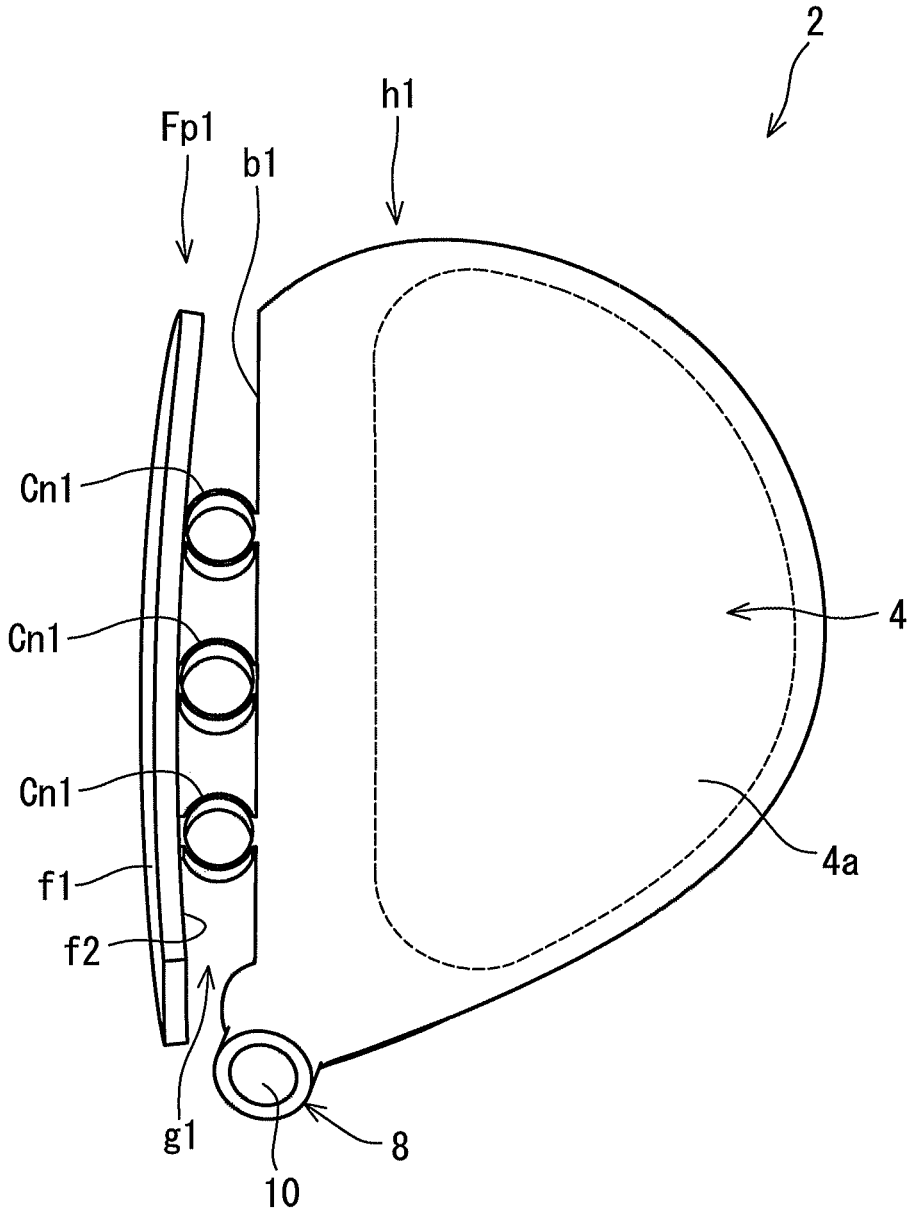
FIG. 3 is a view of the head in FIG. 1 as viewed from obliquely above.
Figure 4:
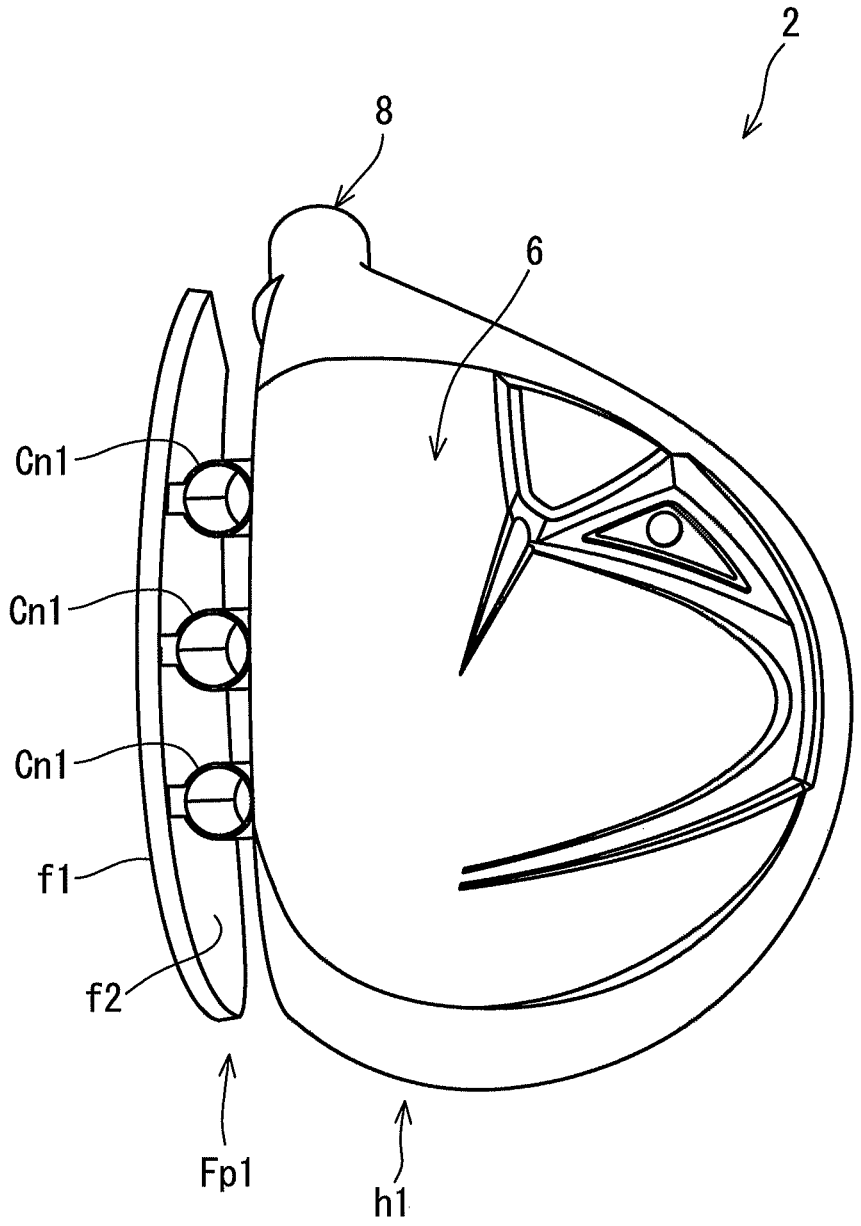
FIG. 4 is a bottom view of the head in FIG. 1 as viewed from below.
Figure 5:
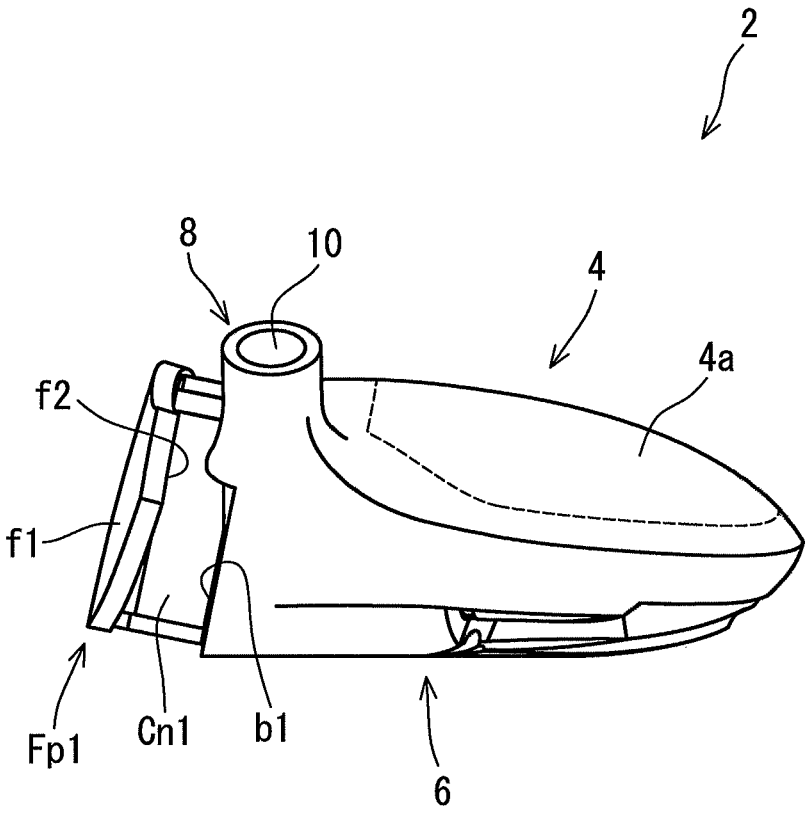
FIG. 5 is a side view of the head in FIG. 1 as viewed from a heel side.

FIG. 1 is a perspective view of a golf club head 2 according to a first embodiment. FIG. 2 is a plan view of the head 2 as viewed from above. FIG. 3 is also a plan view of the head 2 as viewed from above. However, the viewpoint of FIG. 3 is slightly different from the viewpoint of FIG. 2. FIG. 3 is viewed from a viewpoint at which the loft angle is observed to be almost zero. FIG. 3 clearly shows a gap between a head body and a face part. FIG. 4 is a bottom view of the head 2 as viewed from below. FIG. 5 is a side view of the head 2 as viewed from the heel side. FIG. 6 is a front view of the head 2 as viewed from the striking face side.

The head 2 is a wood type head. The head 2 is a fairway wood type head. The head 2 may be a driver head. The head 2 may be a utility type (hybrid type) head. The head 2 may be an iron type head. The head 2 may be a putter type head.

The head 2 includes a head body h1, a face part Fp1, and a connecting part Cn1. The connecting part Cn1 connects the head body h1 and the face part Fp1. The face part Fp1 is connected to the head body h1 by only the connecting part Cn1.

The face part Fp1 has a tabular shape. The face part Fp1 includes a front surface that is a striking face f1. The striking face f1 is a curved surface that includes a bulge and a roll. The face part Fp1 is curved along the shape of the striking face f1.

A plurality of score lines are provided on the striking face f1. These score lines are omitted from the drawings.

The inside of the head body h1 is an empty space. In the present application, the "empty space" is a concept that includes a hollow portion and a recess portion. The empty space may be an enclosed space. Alternatively, the empty space may be a space opened to the outside, such as a recess portion. In the head 2, the inside of the head body h1 is an enclosed space. The head body h1 is hollow.

The head body h1 includes a crown 4, a sole 6, and a hosel 8. The hosel 8 includes a hosel hole 10. A part of the crown 4 is constituted by a lid member 4*a*. In FIG. 2 for example, the contour line of the lid member 4*a* is shown by a dashed line. An opening provided on the head body h1 is covered with the lid member 4*a*. The lid member 4*a* may be formed by a carbon fiber reinforced plastic (CFRP), for example. The lid member 4*a* may have a specific gravity smaller than that of the head body h1 except the lid member 4*a*. Structures of the head body h1 and the crown 4 are not limited. For example, the head body h1 need not include an opening. The crown 4 need not include the lid member 4*a*. The whole crown 4 may be integrally formed.

The head body h1 includes a front portion Fb1. The front portion Fb1 constitutes a front face of the head body h1. The front portion Fb1 is disposed frontward of the empty space of the head body h1. The front portion Fb1 blocks up the front of the empty space. The front portion Fb1 is located rearward of the face part Fp1. The front portion Fb1 and the face part Fp1 are substantially parallel to each other. The front portion Fb1 is located rearwardly apart from the face part Fp1.

In the head 2, the front portion Fb1 is located at a foremost position of the head body h1. Alternatively, the front portion Fb1 need not be located at the foremost position of the head body h1. For example, the front portion Fb1 may be located rearward of a front edge of the head body h1.

The front portion Fb1 connects an upper portion of the head body h1 and a lower portion of the head body h1. In the present embodiment, the upper portion of the head body h1 is the crown 4. In the present embodiment, the lower portion of the head body h1 is the sole 6. The face part Fp1 is connected to the front portion Fb1 by only the connecting part Cn1.

The connecting part Cn1 may be integrally formed with the face part Fp1 and/or the front portion Fb1. Examples of the method of this integral forming include lost-wax casting. The connecting part Cn1 may be joined to the face part Fp1. The connecting part Cn1 may be joined to the front portion Fb1. In light of strength, the joining method is preferably welding.

The face part Fp1 includes the striking face f1 and a face rear surface f2. The striking face f1 is a surface that strikes a ball. The face rear surface f2 is opposed to a front face b1 of the front portion Fb1.

The face part Fp1 and the front portion Fb1 are spaced apart from each other in the front-rear direction. A gap g1 is provided between the face part Fp1 and the front portion Fb1 (see FIG. 3).

The striking face f1 is a curved surface. The striking face f1 is a three-dimensional curved surface that projects outward (forward). As with a general wood type head, the striking face f1 includes a bulge and a roll.

The face rear surface f2 is a curved concave surface. The face part Fp1 has a constant thickness. Alternatively, the face rear surface f2 may be a flat surface, for example.

The connecting part Cn1 connects the face rear surface f2 and the front face b1. A gap is present between the face rear surface f2 and the front face b1 except a portion in which the connecting part Cn1 is present.

Figure 7:
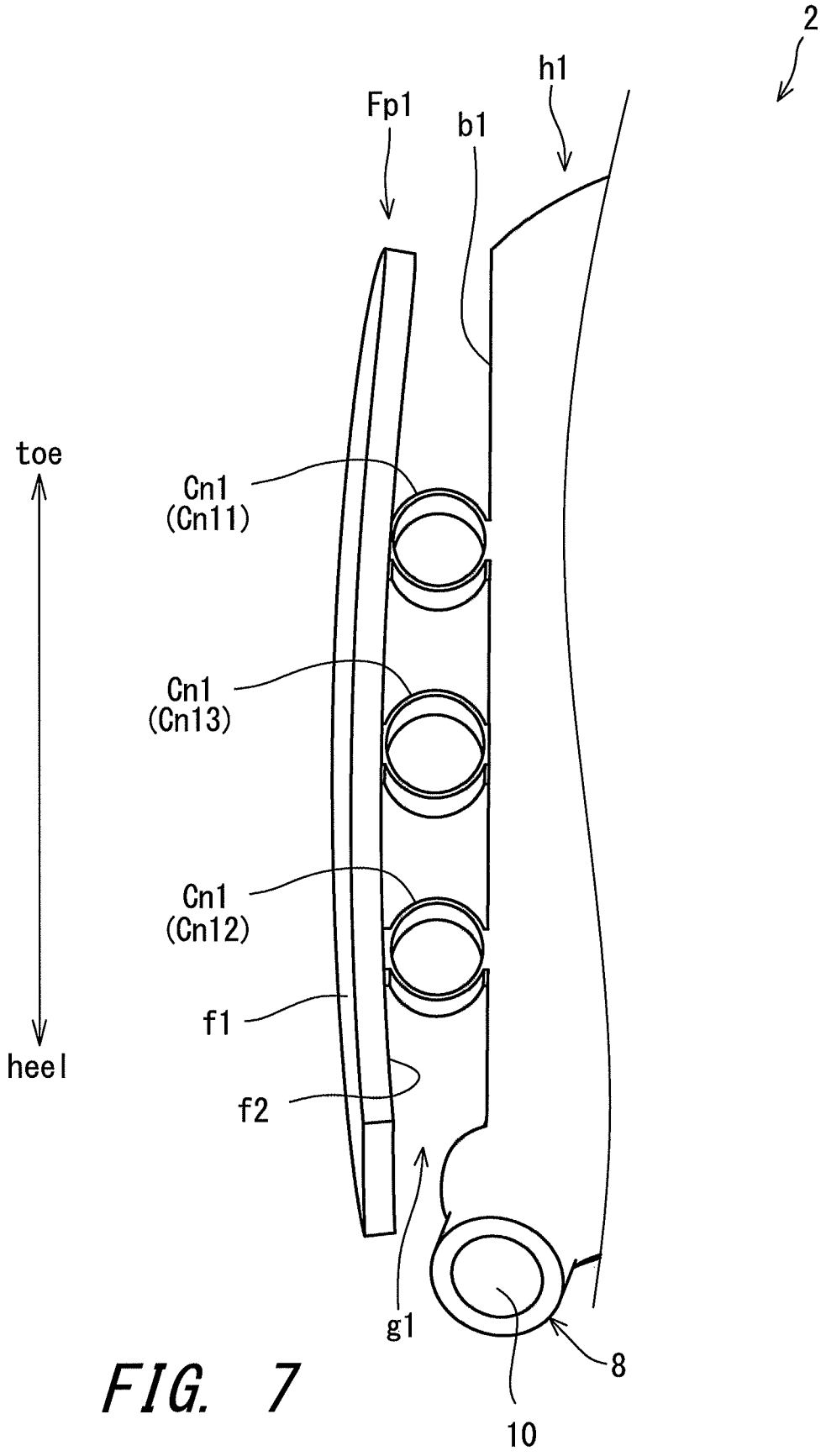
FIG. 7 is a partially enlarged view of FIG. 3.

FIG. 7 is an enlarged view obtained by enlarging a part of FIG. 3.

The head 2 is provided with three connecting parts Cn1. The number of the connecting parts Cn1 may be 1, or may be 2 or more. In light of stably supporting the face part Fp1, the number of the connecting parts Cn1 is preferably greater than or equal to 2, and more preferably greater than or equal to 3. The plurality of connecting parts Cn1 contribute to a reliable support to the face surface Fp1, particularly when the head body h1 and the face part Fp1 are connected to each other by only the connecting parts Cn1. Meanwhile, an excessively large number of the connecting parts Cn1 make the structure of the head complicated and increase manufacturing costs. In this respect, the number of the connecting parts Cn1 is preferably less than or equal to 10, more preferably less than or equal to 8, and still more preferably less than or equal to 6.

The plurality of (three) connecting parts Cn1 are arranged at equal intervals. Alternatively, the plurality of (three) connecting parts Cn1 may be arranged at various intervals.

The head 2 includes a connecting part Cn11 located on the toe-most side in the connecting parts Cn1 and a connecting part Cn12 located on the heel-most side in the connecting parts Cn1. The head 2 further includes a connecting part Cn13 located between the connecting part Cn11 and the connecting part Cn12. A clearance between the connecting parts Cn1 adjacent to each other penetrates the head 2 in the up-down direction. The clearance between the connecting parts Cn1 adjacent to each other passes through the head 2 from the crown side to the sole side.

The connecting parts Cn1 have respective center lines that are substantially parallel to the striking face f1. The center lines of the respective connecting parts Cn1 are oriented in the same direction. The orientation of the center lines of the respective connecting parts Cn1 is not limited. The center line of one connecting part Cn1 is an axis line Z (described later) of the connecting part Cn1.

Figure 8:
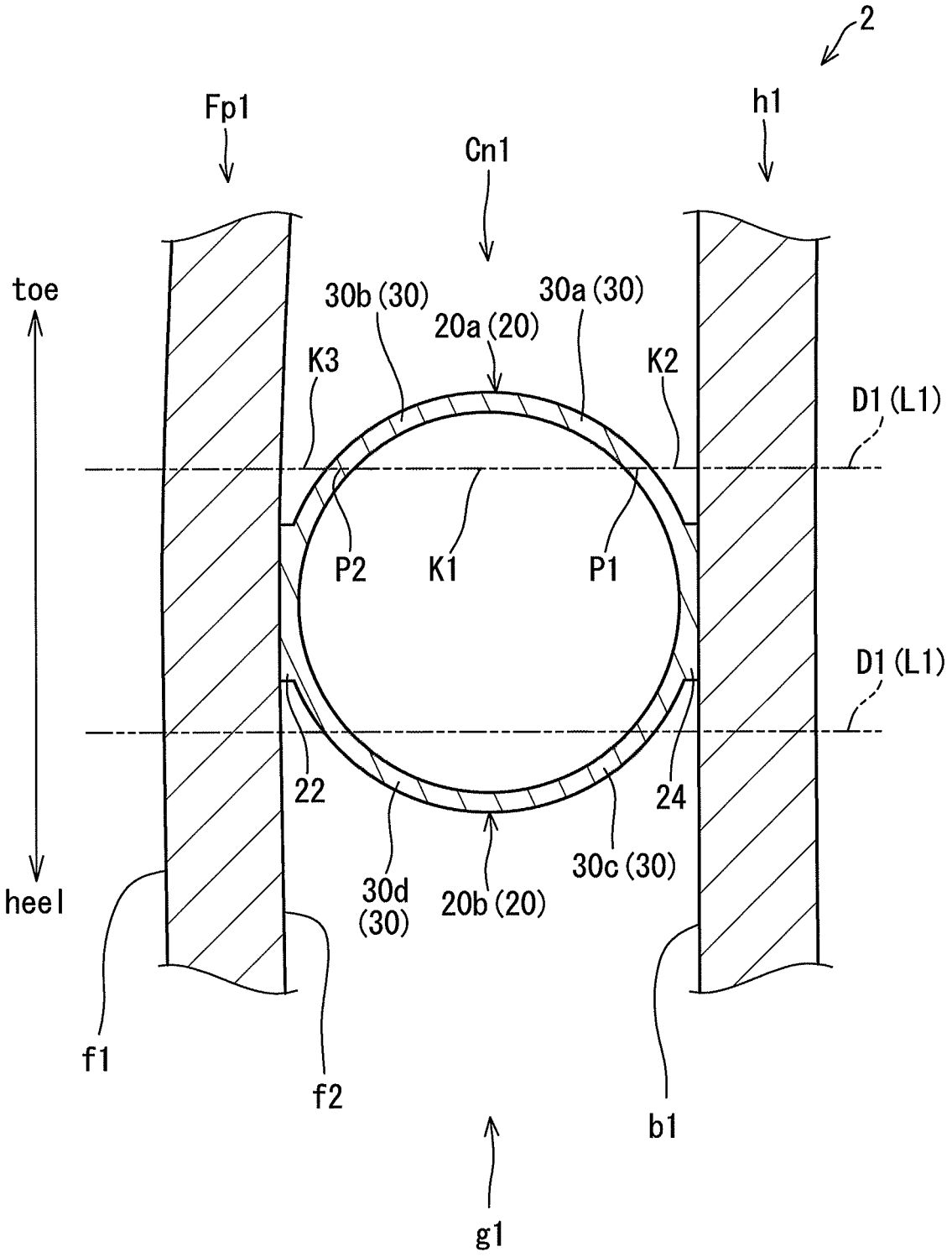
FIG. 8 is an enlarged cross-sectional view showing a connecting part and its vicinity of the head in FIG. 1.

FIG. 8 is a cross-sectional view of one connecting part Cn1 and its vicinity. Each connecting part Cn1 includes a cylindrical portion 20. The cylindrical portion 20 has a cylindrical shape. The cylindrical portion 20 is hollow inside. The cylindrical portion 20 is opened upward (toward the crown side). The cylindrical portion 20 is opened downward (toward the sole side).

The connecting part Cn1 includes a face joint portion 22. The face joint portion 22 is located between the cylindrical portion 20 and the face rear surface f2. The face joint portion 22 occupies a gap between the cylindrical portion 20 and the face rear surface f2. The face joint portion 22 enlarges an area for joining the cylindrical portion 20 to the face rear surface f2. At least a part of the face joint portion 22 may be weld bead. Although FIG. 8 shows the boundary line between the face joint portion 22 and the face part Fp1, the boundary line might be absent or unclear when the joining is performed by welding. When the face part Fp1 and the connecting part Cn1 are integrally formed, the boundary line is absent.

The connecting part Cn1 includes a body joint portion 24. The body joint portion 24 is located between the cylindrical portion 20 and the front face b1. The body joint portion 24 occupies a gap between the cylindrical portion 20 and the front face b1. The body joint portion 24 enlarges an area for joining the cylindrical portion 20 to the front face b1. At least a part of the body joint portion 24 may be weld bead. Although FIG. 8 shows the boundary line between the body joint portion 24 and the head body h1, the boundary line might be absent or unclear when the joining is performed by welding. When the head body h1 and the connecting part Cn1 are integrally formed, the boundary line is absent.

The connecting part Cn1 includes an inclination portion 30 which extends while inclining with respect to the face perpendicular direction. In the present embodiment, the inclination portion 30 extends while inclining in a cross section that is parallel to the horizontal plane HP. The inclination portion 30 is provided between the face joint portion 22 and the body joint portion 24. In the present embodiment, the cylindrical portion 20 includes the inclination portion 30. FIG. 8 shows the face perpendicular direction D1 by using two-dot chain lines. As shown, in FIG. 8, the cylindrical portion 20 includes a first semi-cylinder 20*a* and a second semi-cylinder 20*b*.

The first semi-cylinder 20*a* includes, as the inclination portion 30, a first inclination portion 30*a* inclining so as to go toward the toe side as it approaches the face part Fp1, and a second inclination portion 30*b* inclining so as to go toward the heel side as it approaches the face part Fp1. The second inclination portion 30*b* is located between the first inclination portion 30*a* and the face part Fp1. The first inclination portion 30*a* is continuous with the second inclination portion 30*b*. The inclination of the second inclination portion 30*b* is inverted with respect to the inclination of the first inclination portion 30*a*. The first inclination portion 30*a* and the second inclination portion 30*b* are inclined inversely to each other, thereby facilitating elastic deformation of the connecting part Cn1 at impact.

The first inclination portion 30*a* is an arc inclination portion that extends along a circular arc. The second inclination portion 30*b* is an arc inclination portion that extends along a circular arc. These arc inclination portions facilitate the elastic deformation of the connecting part Cn1 at impact.

In each of the first inclination portion 30*a* and the second inclination portion 30*b*, an angle formed by the face perpendicular direction D1 and the extending direction of the inclination portion 30 (the first inclination portion 30*a*, the second inclination portion 30*b*) gradually varies. Of the first semi-cylinder 20*a*, portions in which the angle formed by the face perpendicular direction D1 and the extending direction of the first semi-cylinder 20*a* is not 0 degree or 90 degrees are the inclination portion 30. This angle on a peak portion of the first semi-cylinder 20*a* is 0 degree, and thus the peak portion is not the inclination portion. The peak portion which is not the inclination portion is located on the boundary between the first inclination portion 30*a* and the second inclination portion 30*b*. Except for the peak portion, substantially the entirety of the first semi-cylinder 20*a* is the inclination portion 30.

The second semi-cylinder 20*b* includes, as the inclination portion 30, a first inclination portion 30*c* inclining so as to go toward the heel side as it approaches the face part Fp1, and a second inclination portion 30*d* inclining so as to go toward the toe side as it approaches the face part Fp1. The second inclination portion 30*d* is located between the first inclination portion 30*c* and the face part Fp1. The inclination of the second inclination portion 30*d* is inverted with respect to the inclination of the first inclination portion 30*c*. The first inclination portion 30*c* and the second inclination portion 30*d* are inclined inversely to each other, thereby facilitating the elastic deformation of the connecting part Cn1 at impact.

The first inclination portion 30*c* is an arc inclination portion that extends along a circular arc. The second inclination portion 30*d* is an arc inclination portion that extends along a circular arc. These arc inclination portions facilitate the elastic deformation of the connecting part Cn1 at impact.

In each of the first inclination portion 30*c* and the second inclination portion 30*d*, an angle formed by the face perpendicular direction D1 and the extending direction of the inclination portion 30 (the first inclination portion 30*c*, the second inclination portion 30*d*) gradually varies. Of the second semi-cylinder 20*b*, portions in which the angle formed by the face perpendicular direction D1 and the extending direction of the second semi-cylinder 20*b* is not 0 degree or 90 degrees are the inclination portion 30. This angle on a peak portion of the second semi-cylinder 20*b* is 0 degree, and thus the peak portion is not the inclination portion. The peak portion which is not the inclination portion is located on the boundary between the first inclination portion 30*c* and the second inclination portion 30*d*.

Except for the peak portion, substantially the entirety of the second semi-cylinder 20*b* is the inclination portion 30.

As understood from the above descriptions, substantially the entirety of the cylindrical portion 20 is the inclination portion 30.

FIG. 8 is a cross section taken along the face perpendicular direction. In the cross section, the inclination portion 30 extends while inclining with respect to the face perpendicular direction D1. The inclining direction of the inclination portion 30 is not limited. It is required only that the inclination portion 30 incline in any direction with respect to the face perpendicular direction D1. In other words, the head 2 has a cross section in which the extending direction of the inclination portion 30 is inclined with respect to the face perpendicular direction. This cross section is also referred to as a specified cross section. The specified cross section includes a cross section of the face part Fp1, a cross section of the connecting part Cn1, and a cross section of the head body h1. The specified cross section can be arbitrarily selected. The specified cross section clearly shows the inclination of the inclination portion 30 with respect to the face perpendicular direction D1. FIG. 8 is one example of the specified cross section. The specified cross section preferably includes a straight line parallel to the face perpendicular direction D1. Although there are myriads of planes that include the straight line parallel to the face perpendicular direction D1, one of the myriads of planes may be the specified cross section. For example, the specified cross section may be parallel to the horizontal plane HP. For example, the specified cross section may be perpendicular to the horizontal plane HP.

The connecting part Cn1 curvedly extends. This curve allows the connecting part Cn1 to intersect a single straight line parallel to the face perpendicular direction D1 at two or more locations. In the embodiment of FIG. 8, the connecting part Cn1 intersects a straight line L1 which is parallel to the face perpendicular direction D1 at two locations (a first location P1 and a second location P2). The connecting part Cn1 is continuous from the first location P1 to the second location P2 without a break. The location of the straight line L1 can be arbitrarily set. Along the straight line L1, a space K1 is present between the first location P1 and the second location P2. Along the straight line L1, a space K2 is present between the front face b1 and the connecting part Cn1. Along the straight line L1, a space K3 is present between the connecting part Cn1 and the face rear surface f2. These spaces K1, K2 and K3 provide rooms for the connecting part Cn1 to be displaced. These spaces K1, K2 and K3 can facilitate the elastic deformation of the connecting part Cn1.

At least a part of the gap (including an inside space of the connecting part Cn1) between the head body h1 and the face part Fp1 may be filled by a material that does not block the deformation of the connecting part Cn1. This material can prevent a foreign matter from entering the gap. This material can improve appearance of the head 2, and for example, can make the head 2 a similar look in addressing as a general head. Examples of the material include a resin and a rubber.

As described above, the connecting part Cn1 includes the face joint portion 22 and the body joint portion 24. The connecting part Cn1 curvedly extends between the face joint portion 22 and the body joint portion 24. This curvedly extending portion can facilitate the elastic deformation of the connecting part Cn1. The connecting part Cn1 includes a portion that is located between the face joint portion 22 and the body joint portion 24, and that is not parallel to the face perpendicular direction D1. The portion which is not parallel to the face perpendicular direction D1 can facilitate the elastic deformation of the connecting part Cn1. This inclination portion can facilitate the elastic deformation of the connecting part Cn1.

The direction of a force applied on the head 2 by a ball at impact is substantially parallel to the face perpendicular direction D1. Therefore, the inclination portion which inclines with respect to the face perpendicular direction D1 tends to be deformed by this force. The inclination portion can facilitate the elastic deformation of the connecting part Cn1.

Figure 9:
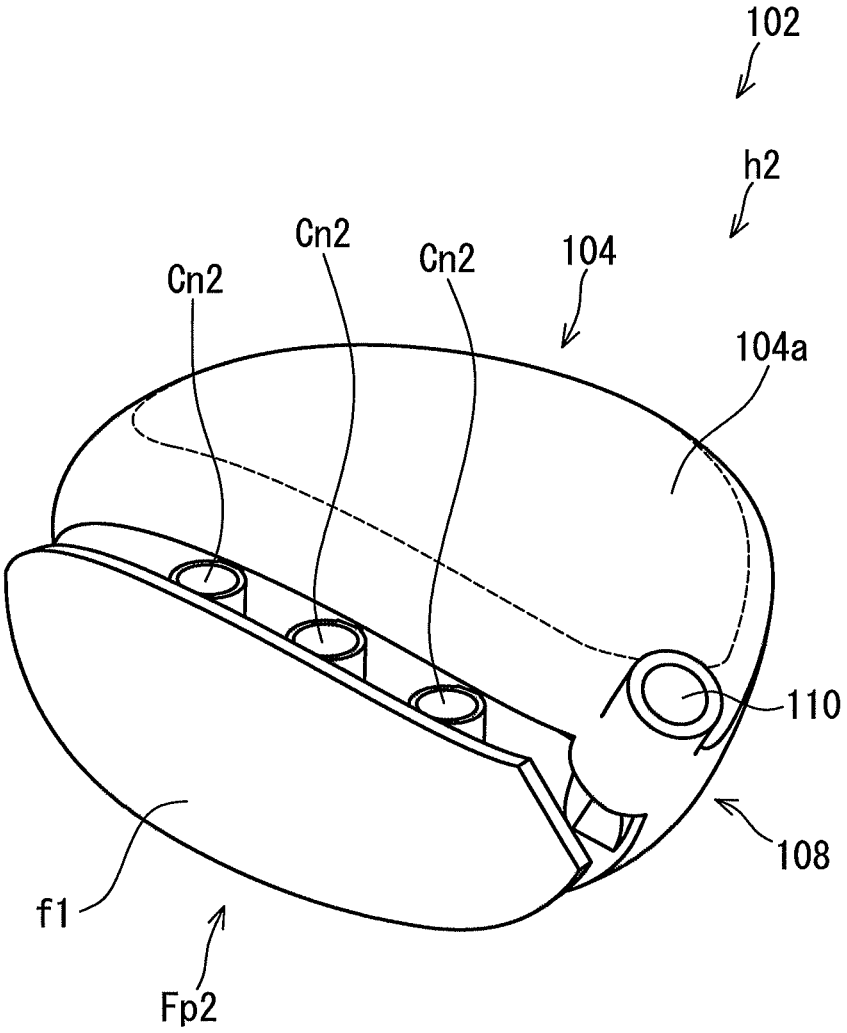
FIG. 9 is a perspective view of a golf club head according to a second embodiment.
Figure 10:
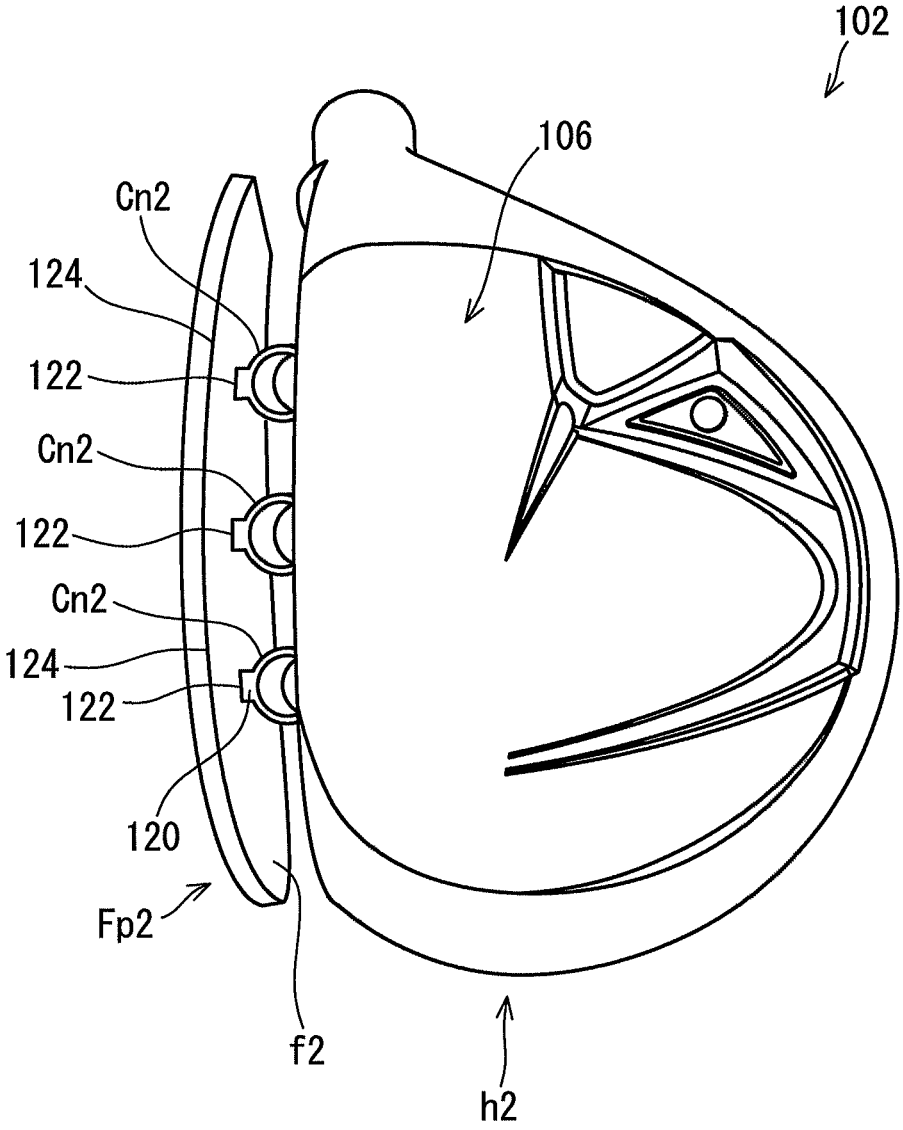
FIG. 10 is a bottom view of the head in FIG. 9 as viewed from below.
Figure 11:
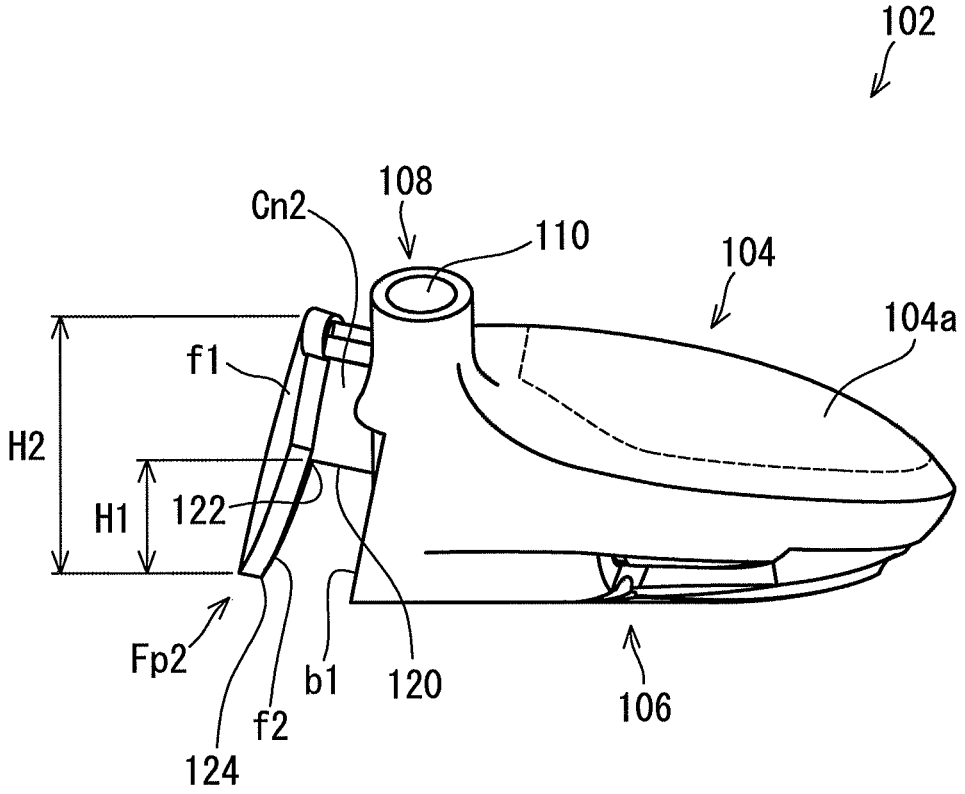
FIG. 11 is a side view of the head in FIG. 9 as viewed from the heel side.

FIG. 9 is a perspective view of a golf club head 102 according to a second embodiment. FIG. 10 is a bottom view of the head 102 as viewed from below. FIG. 11 is a side view of the head 102 as viewed from the heel side.

The head 102 is a wood type head. The head 102 is a fairway wood type head. The head 102 includes a head body h2, a face part Fp2, and a connecting part Cn2. The connecting part Cn2 connects the head body h2 and the face part Fp2. The face part Fp2 is connected to the head body h2 by only the connecting part Cn2. The connecting part Cn2 connects a face rear surface f2 of the face part Fp2 and a front face b1 of the head body h2.

The inside of the head body h2 is an empty space. In the head 102, the inside of the head body h2 is an enclosed space. The head body h2 is hollow.

The head body h2 includes a crown 104, a sole 106, and a hosel 108. The hosel 108 includes a hosel hole 110. A part of the crown 104 is constituted by a lid member 104*a*. FIG. 9 shows the contour line of the lid member 104*a* by using a dashed line. An opening provided on the head body h2 is covered with the lid member 104*a*.

The head 102 is different from the above-described head 2 in length of the connecting parts. The connecting parts Cn2 of the head 102 have shorter lengths as compared with the connecting parts Cn1 of the head 2.

The connecting parts Cn2 connect an upper portion of the face part Fp2 (face rear surface f2) and an upper portion of the head body h2 (front face b1). The connecting parts Cn2 are not provided on a lower portion of the face part Fp2.

A lower end 120 of each connecting part Cn2 includes a lower-end front portion 122 which is brought into contact with the face rear surface f2. The lower-end front portion 122 is located apart from a lower edge 124 of the face rear surface f2.

In the head 102, a lower region of the face part Fp2 (striking face f1) is not supported by the connecting parts Cn2. Therefore, the lower region tends to be displaced rearward at impact. The head 102 is excellent in rebound performance of the lower portion of the striking face f1.

The striking face f1 includes a face lower region in which the whole toe-heel direction position of the striking face f1 is not supported by the connecting parts Cn2. This face lower region is also referred to as a non-backup lower region. The non-backup lower region has a height ranging from the lower end of the striking face f1 to a height H1. When this region is large, the rebound performance of the lower portion of the striking face f1 is enhanced.

As described above, the non-backup lower region is a region in which the whole toe-heel direction position of the striking face f1 is not supported by the connecting parts Cn2. Therefore, in the head 102, the non-backup lower region is a region that is lower than the lowermost lower-end front portion 122 in three lower-end front portions 122.

A double-pointed arrow H1 in FIG. 11 shows the height of the non-backup lower region. The height H1 is measured along the up-down direction. The height H1 is measured at a position (a position in the toe-heel direction) at which the face center fc is present. A double-pointed arrow H2 in FIG. 11 and FIG. 6 shows a height of the striking face f1. The height H2 is measured at the position at which the face center fc is present. The height H2 is measured along the up-down direction.

A fairway wood type head and a utility type head are often used for striking a ball that is placed directly on a lawn. Striking points in these types of heads tend to be located on the lower portion of the face. In light of emphasizing rebound performance in the lower portion of the face part Fp2, H1/H2 is preferably greater than or equal to 0.3, more preferably greater than or equal to 0.35, still more preferably greater than or equal to 0.4, and yet still more preferably greater than or equal to 0.45. In view of joining strength between the connecting part Cn2 and the face part Fp2, H1/H2 is preferably less than or equal to 0.8, more preferably less than or equal to 0.75, still more preferably less than or equal to 0.7, and yet still more preferably less than or equal to 0.65. When a plurality of connecting parts Cn2 are provided, all the connecting parts Cn2 preferably satisfy these requirements.

Figure 12:
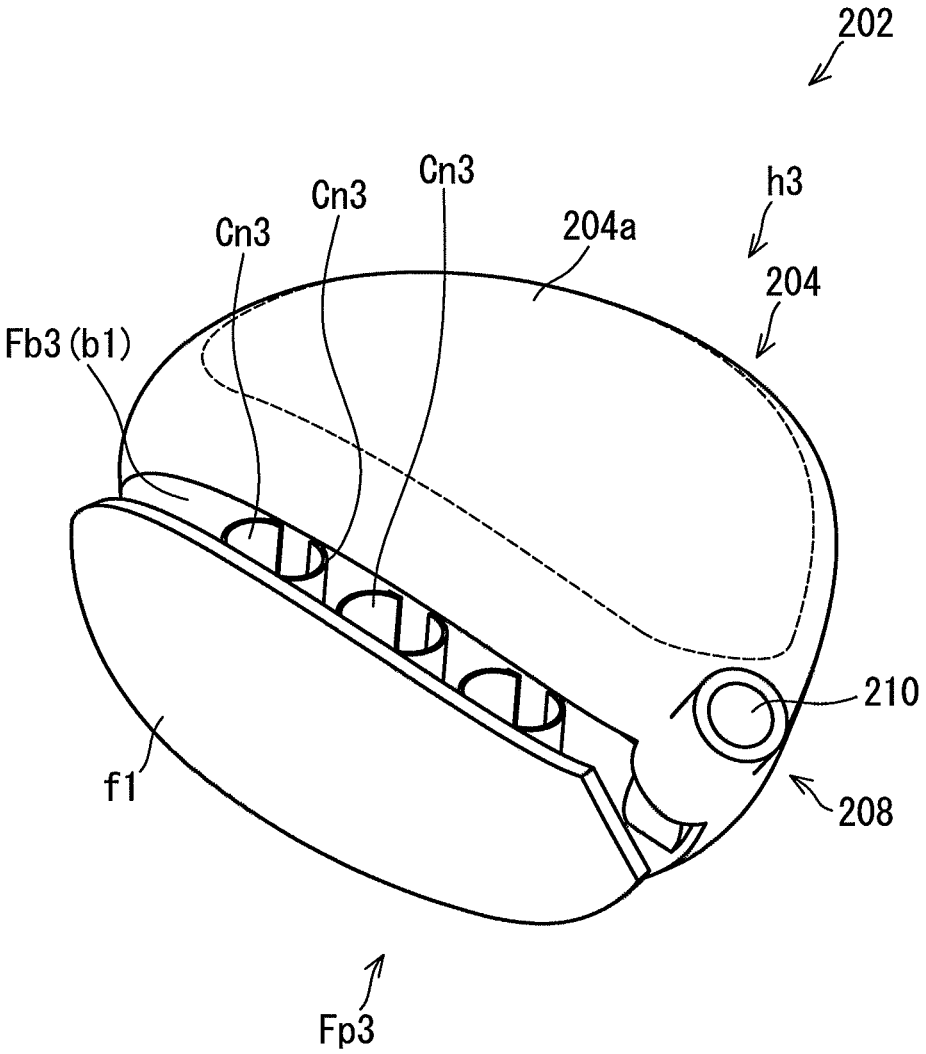
FIG. 12 is a perspective view of a golf club head according to a third embodiment.
Figure 13:
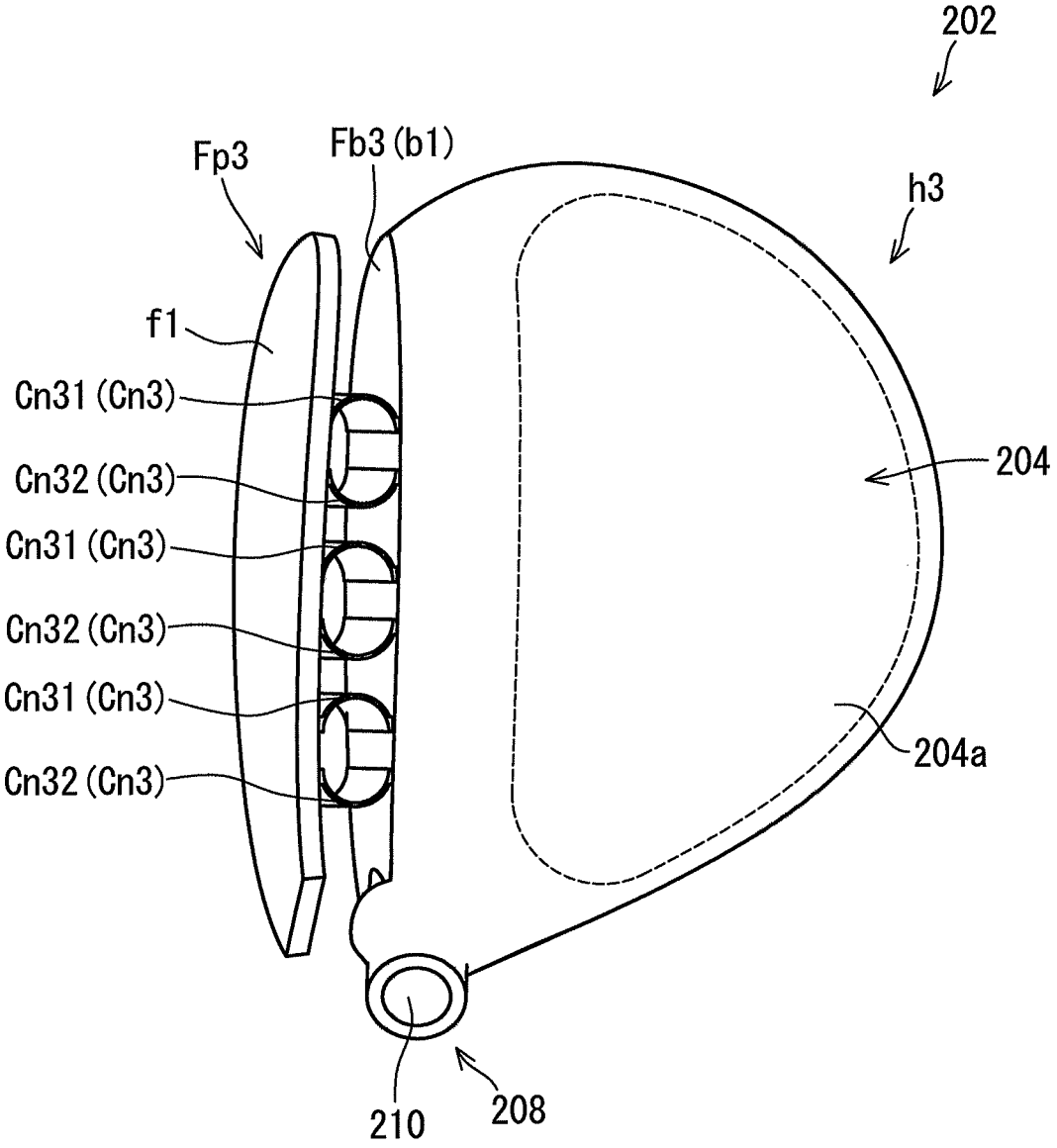
FIG. 13 is a plan view of the head in FIG. 12 as viewed from above.
Figure 14:
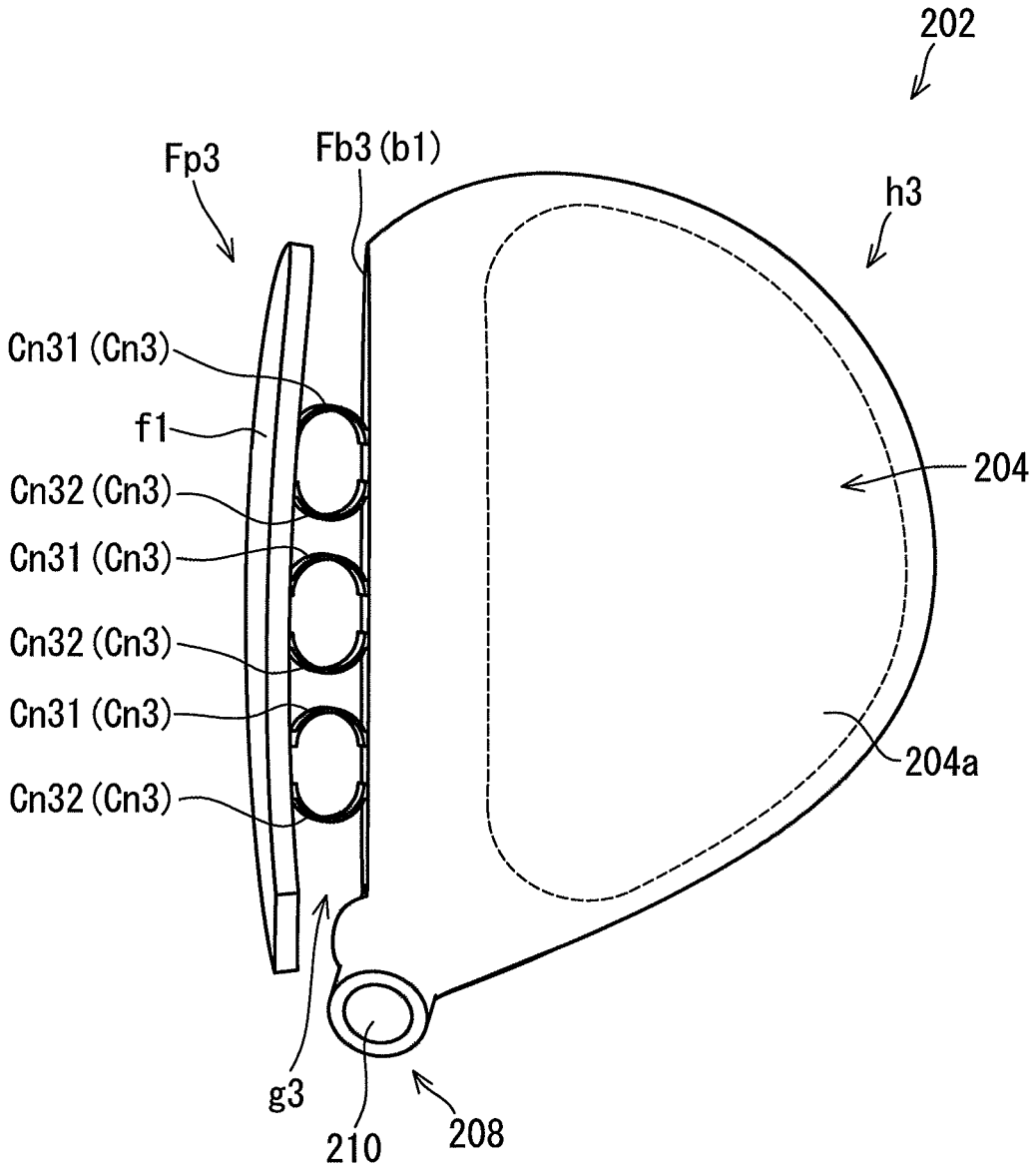
FIG. 14 is a view of the head in FIG. 12 as viewed from obliquely above.
Figure 15:
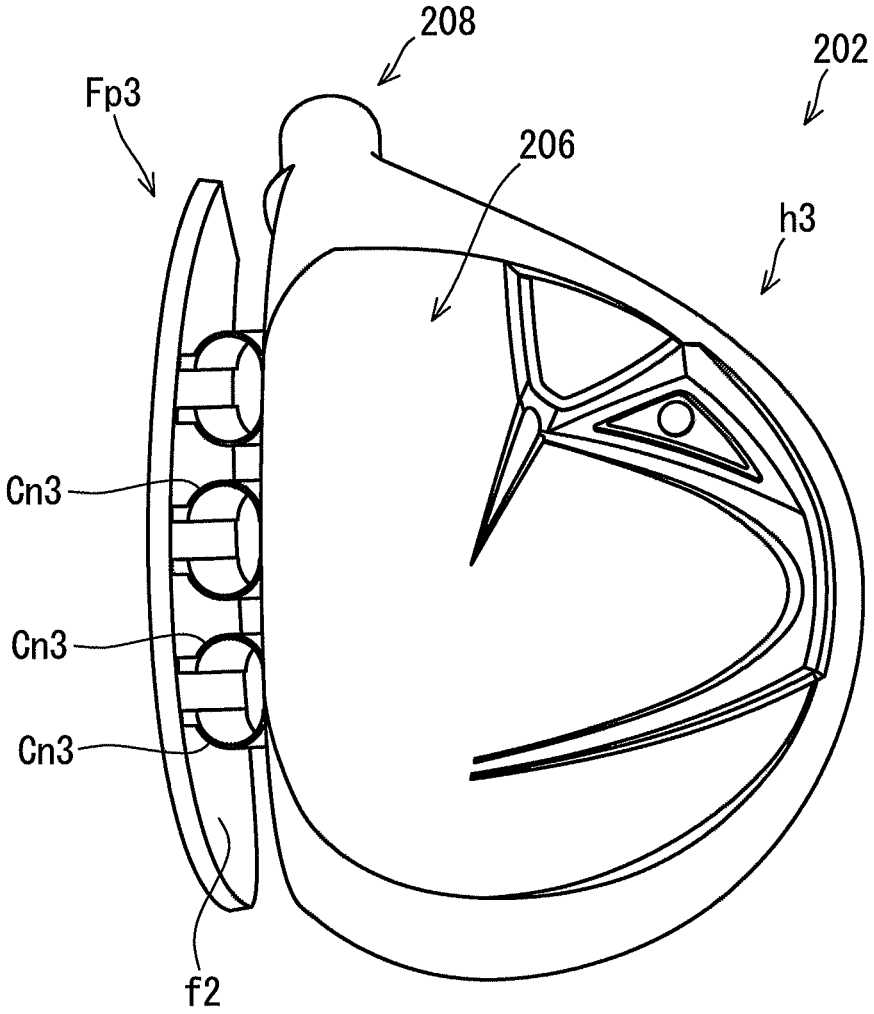
FIG. 15 is a bottom view of the head in FIG. 12 as viewed from below.
Figure 16:
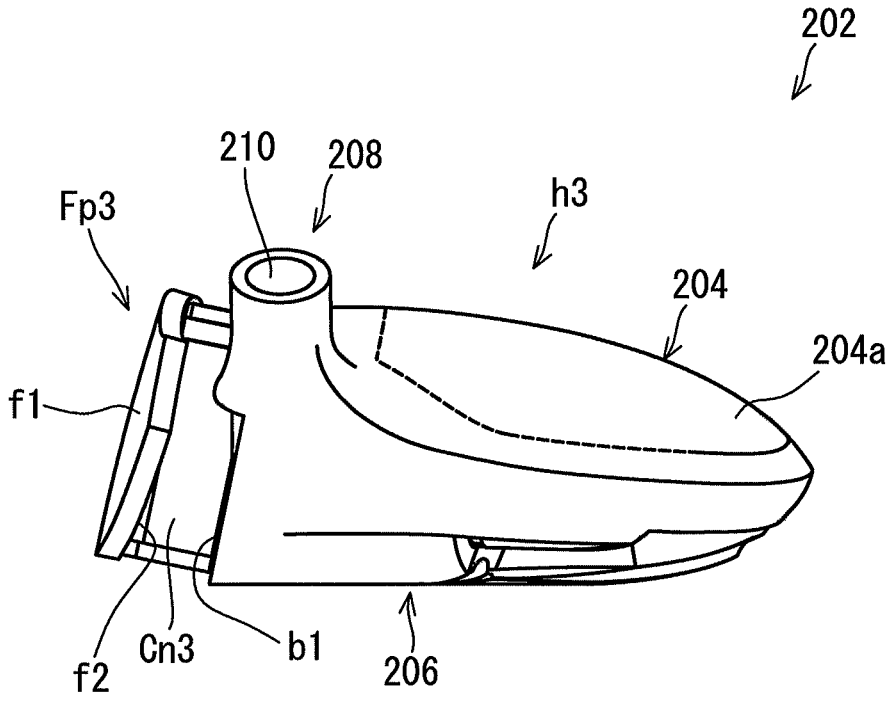
FIG. 16 is a side view of the head in FIG. 12 as viewed from the heel side.
Figure 17:
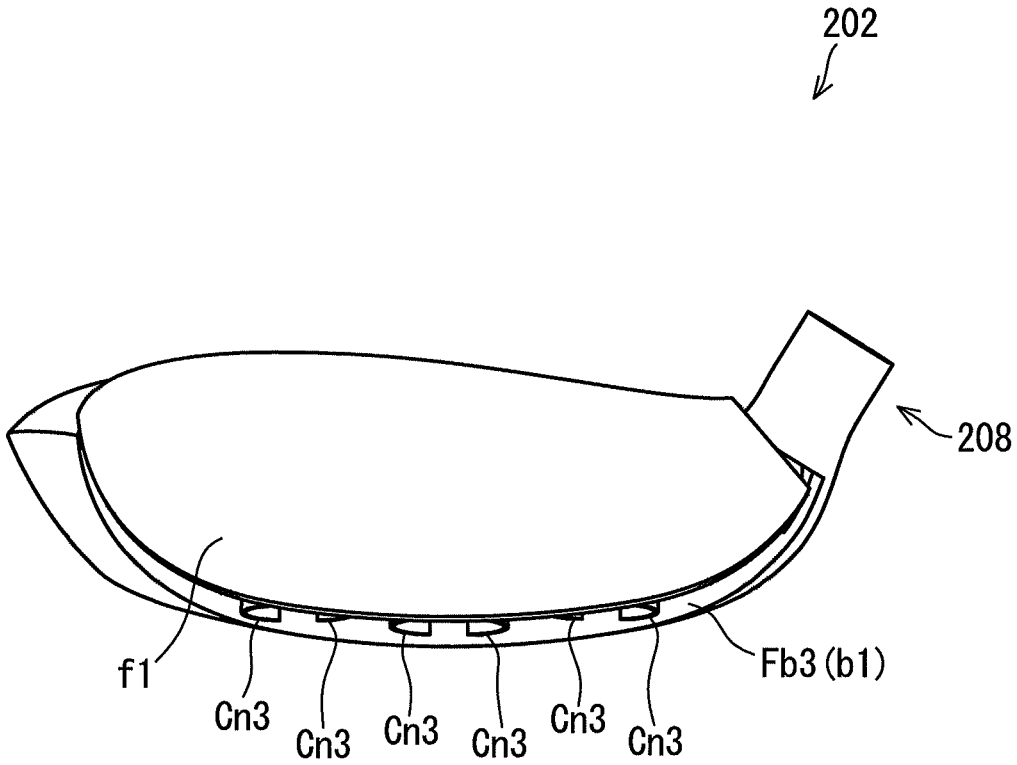
FIG. 17 is a front view of the head in FIG. 12.

FIG. 12 is a perspective view of a golf club head 202 of a third embodiment. FIG. 13 is a plan view of the head 202 as viewed from above. FIG. 14 is also a plan view of the head 202 as viewed from above. However, the viewpoint of FIG. 14 is slightly different from the viewpoint of FIG. 13. FIG. 14 is viewed from a viewpoint at which the loft angle is observed to be almost zero. FIG. 14 clearly shows a gap between a head body and a face part. FIG. 15 is a bottom view of the head 202 as viewed from below. FIG. 16 is a side view of the head 202 as viewed from the heel side. FIG. 17 is a front view of the head 202 as viewed from the striking face side.

The head 202 is a wood type head. The head 202 is a fairway wood type head.

The head 202 includes a head body h3, a face part Fp3 and a connecting part Cn3. The connecting part Cn3 connects the head body h3 and the face part Fp3. The face part Fp3 is connected to the head body h3 by only the connecting part Cn3.

The face part Fp3 has a tabular shape. The face part Fp3 includes a front surface that is a striking face f1. The striking face f1 is a curved surface that includes a bulge and a roll. The face part Fp3 is curved along the shape of the striking face f1.

A plurality of score lines are provided on the striking face f1. These score lines are omitted from the drawings.

The inside of the head body h3 is an empty space. The head body h3 is hollow.

The head body h3 includes a crown 204, a sole 206, and a hosel 208. The hosel 208 includes a hosel hole 210. A part of the crown 204 is constituted by a lid member 204*a*. The contour line of the lid member 204*a* is shown by using a dashed line. An opening provided on the head body h3 is covered with the lid member 204*a*.

The head body h3 includes a front portion Fb3. The front portion Fb3 constitutes a front face of the head body h3. The front portion Fb3 is disposed frontward of the empty space of the head body h3. The front portion Fb3 blocks up the front of the empty space. The front portion Fb3 is located rearward of the face part Fp3. The front portion Fb3 and the face part Fp3 are substantially parallel to each other. The front portion Fb3 is located rearwardly apart from the face part Fp3.

In the head 202, the front portion Fb3 is located at a foremost position of the head body h3. Alternatively, the front portion Fb3 need not be located at the foremost position of the head body h3. For example, the front portion Fb3 may be located rearward of a front edge of the head body h3.

The front portion Fb3 connects an upper portion of the head body h3 and a lower portion of the head body h3. In the present embodiment, the upper portion of the head body h3 is the crown 204. In the present embodiment, the lower portion of the head body h3 is the sole 206. The face part Fp3 is connected to the front portion Fb3 by only the connecting part Cn3.

The face part Fp3 includes the striking face f1 and a face rear surface f2. The striking face f1 is a surface that strikes a ball. The face rear surface f2 is opposed to a front face b1 of the front portion Fb3.

The face part Fp3 and the front portion Fb3 are spaced apart from each other in the front-rear direction. A gap g3 is provided between the face part Fp3 and the front portion Fb3 (see FIG. 14).

The striking face f1 is a curved surface. The striking face f1 is a three-dimensional curved surface that projects outward (forward). As with a general wood type head, the striking face f1 includes a bulge and a roll.

The face rear surface f2 is a curved concave surface. The face part Fp3 has a constant thickness. Alternatively, the face rear surface f2 may be a flat surface, for example.

The head 202 is provided with six connecting parts Cn3. The connecting parts Cn3 connect the face rear surface f2 and the front face b1. A gap is present between the face rear surface f2 and the front face b1 except a portion in which the connecting part Cn3 is present.

Figure 18:
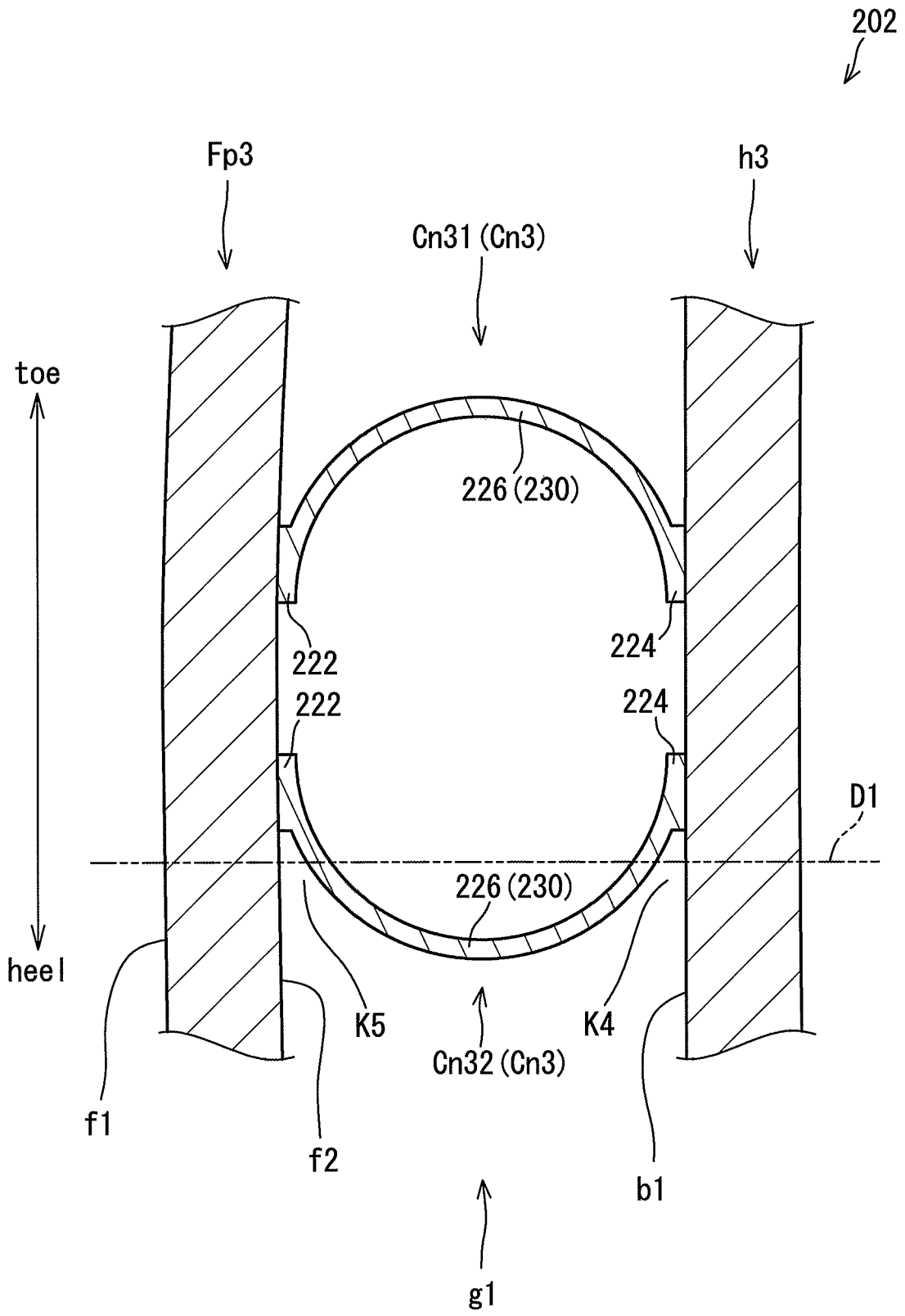
FIG. 18 is an enlarged cross-sectional view showing a connecting part and its vicinity of the head in FIG. 12.

FIG. 18 is a cross-sectional view of two connecting parts Cn3 and their vicinity.

Each connecting part Cn3 includes a face joint portion 222, a body joint portion 224, and a main portion 226. The main portion 226 has a semi-cylindrical shape. The face joint portion 222 is located between the main portion 226 and the face rear surface f2. The face joint portion 222 enlarges an area for joining the main portion 226 to the face rear surface f2. At least a part of the face joint portion 222 may be weld bead. The body joint portion 224 is located between the front face b1 of the head body h3 and the main portion 226. The body joint portion 224 enlarges an area for joining the main portion 226 to the front face b1. At least a part of the body joint portion 224 may be weld bead.

Each connecting part Cn3 includes an inclination portion 230 which extends while inclining with respect to the face perpendicular direction D1. The inclination portion 230 is provided between the face joint portion 222 and the body joint portion 224. In the present embodiment, the main portion 226 includes the inclination portion 230. The semi-cylindrical main portion 226 inclines with respect to the face perpendicular direction D1 except a peak portion thereof. Therefore, a large part of the main portion 226 is the inclination portion 230. A space K4 is present between the inclination portion 230 and the head body h3. A space K5 is present between the inclination portion 230 and the face part Fp3.

The plurality of connecting parts Cn3 include first connecting parts Cn31 which curve so as to project toward the toe side, and second connecting parts Cn32 which curve so as to project toward the heel side. The first connecting parts Cn31 and the second connecting parts Cn32 are alternately arranged (see FIG. 13). One of the second connecting parts Cn32 is disposed on the heel side of one of the first connecting parts Cn31. A plurality of (three) pairs of the one first connecting part Cn31 and the one second connecting part Cn32 are provided.

Figure 19:
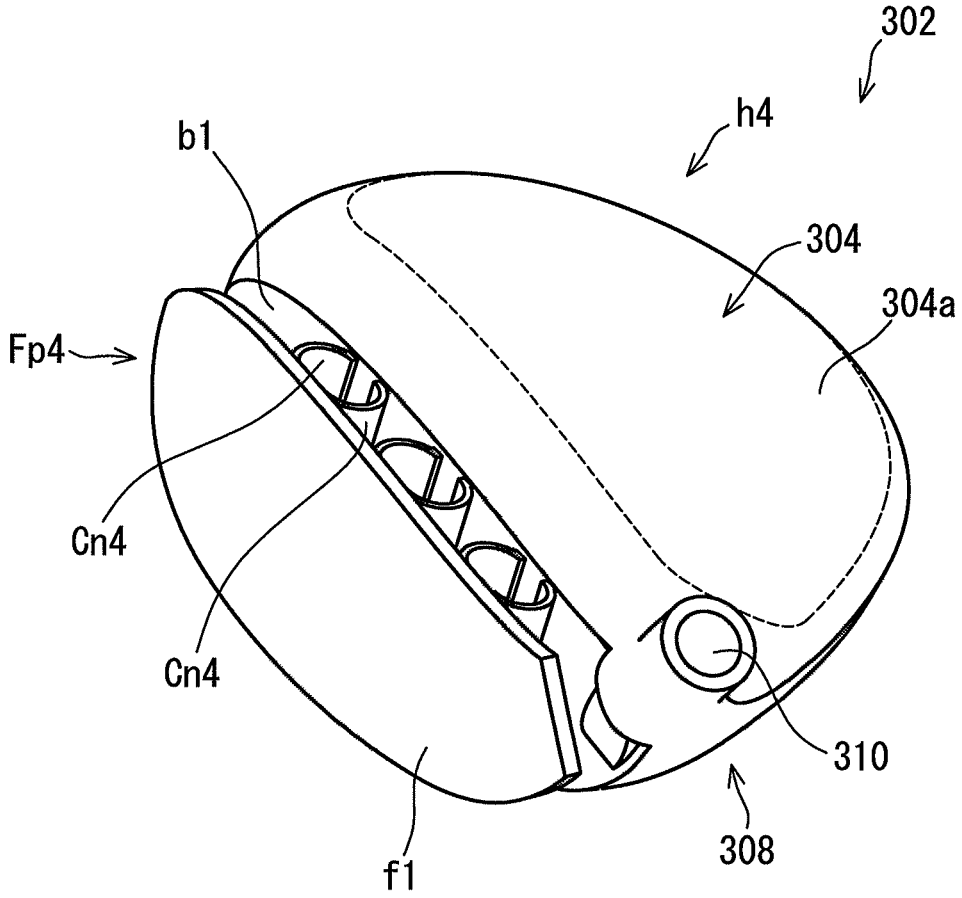
FIG. 19 is a perspective view of a head according to a fourth embodiment.
Figure 20:
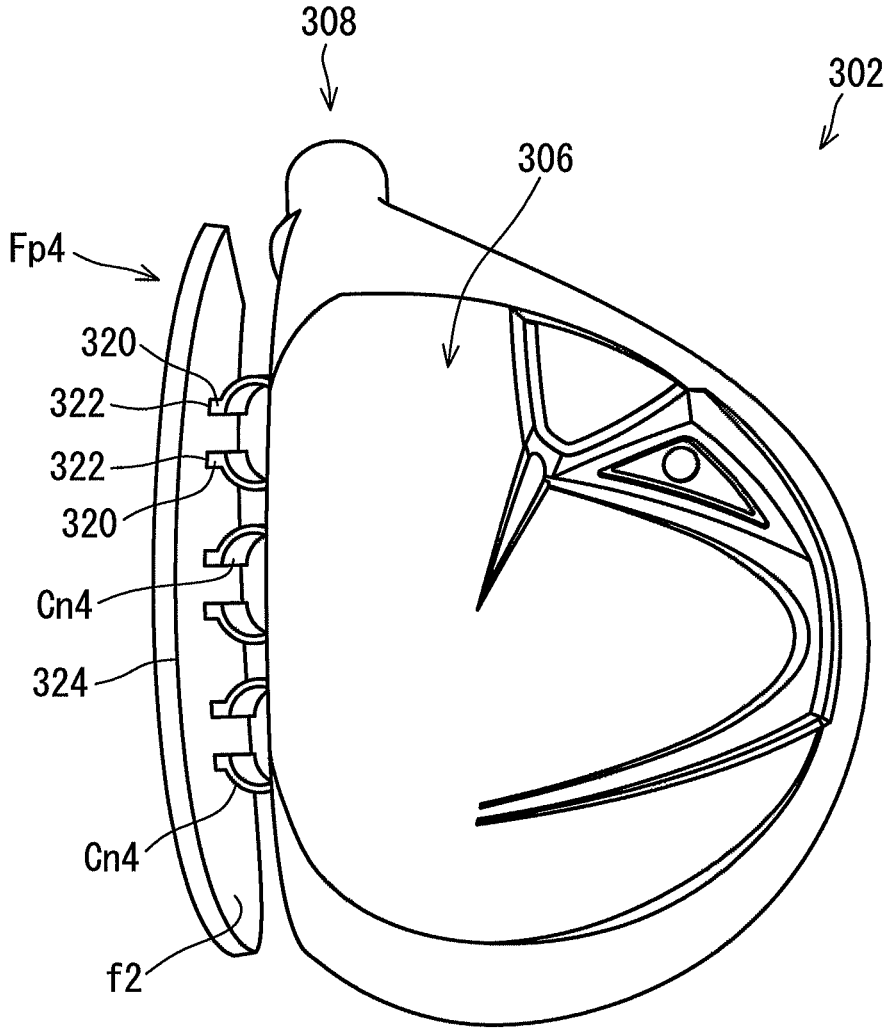
FIG. 20 is a bottom view of the head in FIG. 19 as viewed from below.
Figure 21:
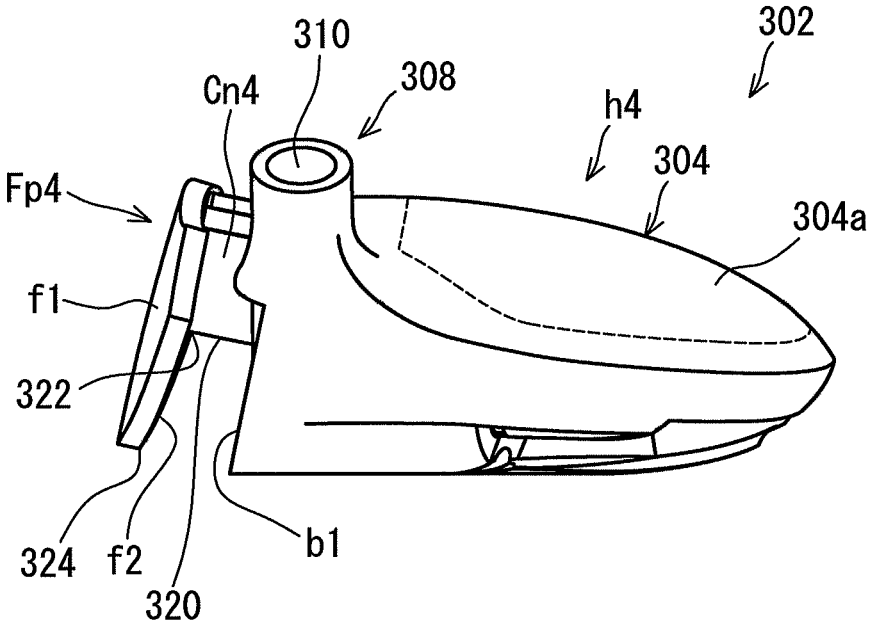
FIG. 21 is a side view of the head in FIG. 19 as viewed from the heel side.

FIG. 19 is a perspective view of a golf club head 302 according to a fourth embodiment. FIG. 20 is a bottom view of the head 302 as viewed from below. FIG. 21 is a side view of the head 302 as viewed from the heel side.

The head 302 is a wood type head. The head 302 is a fairway wood type head. The head 302 includes a head body h4, a face part Fp4, and a connecting part Cn4. The connecting part Cn4 connects the head body h4 and the face part Fp4. The face part Fp4 is connected to the head body h4 by only the connecting part Cn4. The connecting part Cn4 connects a face rear surface f2 of the face part Fp4 and a front face b1 of the head body h4.

The inside of the head body h4 is an empty space. In the head 302, the inside of the head body h4 is an enclosed space. The head body h4 is hollow.

The head body h4 includes a crown 304, a sole 306, and a hosel 308. The hosel 308 includes a hosel hole 310. A part of the crown 304 is constituted by a lid member 304*a*. In FIG. 19 for example, the contour line of the lid member 304*a* is shown by using a dashed line. An opening provided on the head body h4 is covered with the lid member 304*a*.

The head 302 is different from the above-described head 202 in length of the connecting parts. The connecting parts Cn4 of the head 302 have shorter lengths as compared with the connecting parts Cn3 of the head 202.

The connecting parts Cn4 connect an upper portion of the face part Fp4 (face rear surface f2) and an upper portion of the head body h4 (front face b1). The connecting parts Cn4 are not provided on a lower portion of the face part Fp4.

A lower end 320 of each connecting part Cn4 includes a lower-end front portion 322 which is brought into contact with the face rear surface f2. The lower-end front portion 322 is located apart from a lower edge 324 of the face rear surface f2.

In the head 302, a lower region of the face part Fp4 (striking face f1) is not supported by the connecting parts Cn4. Therefore, the lower region tends to be displaced rearward at impact. The head 302 is excellent in rebound performance when a ball is struck with a lower portion of the striking face f1. The head 302 is excellent in rebound performance of the lower portion of the striking face f1.

Figure 22:
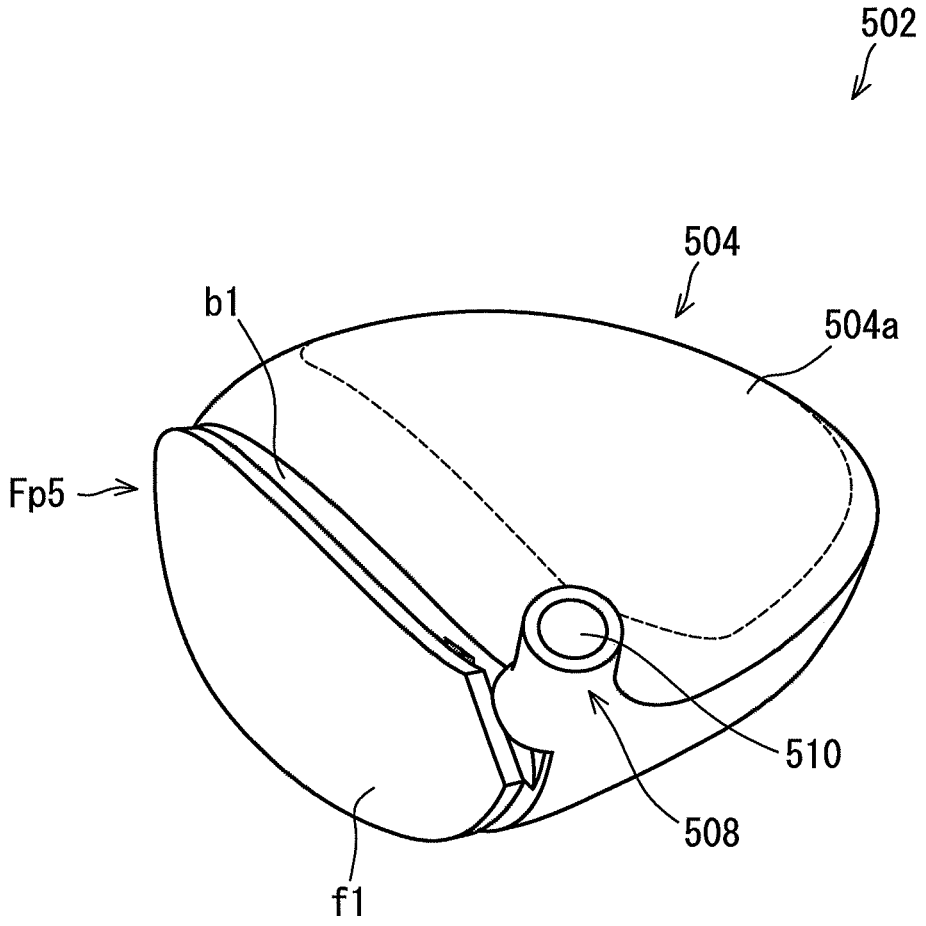
FIG. 22 is a perspective view of a golf club head of a referential example.
Figure 23:
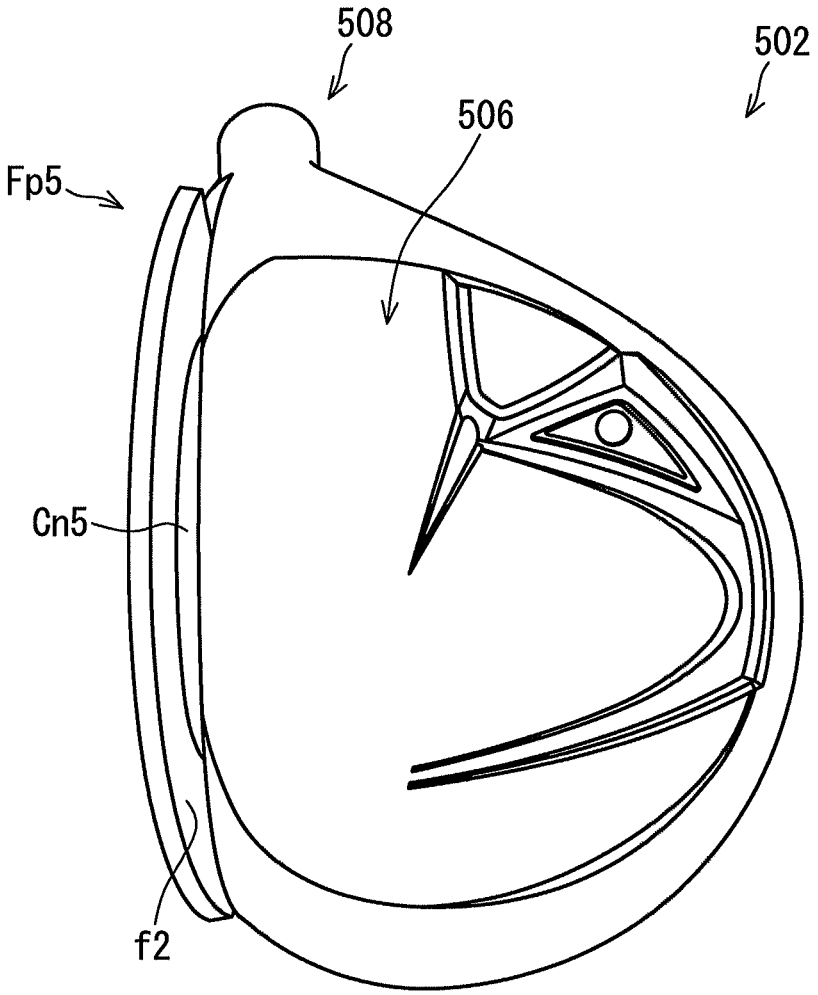
FIG. 23 is a bottom view of the head in FIG. 22 as viewed from below.
Figure 24:
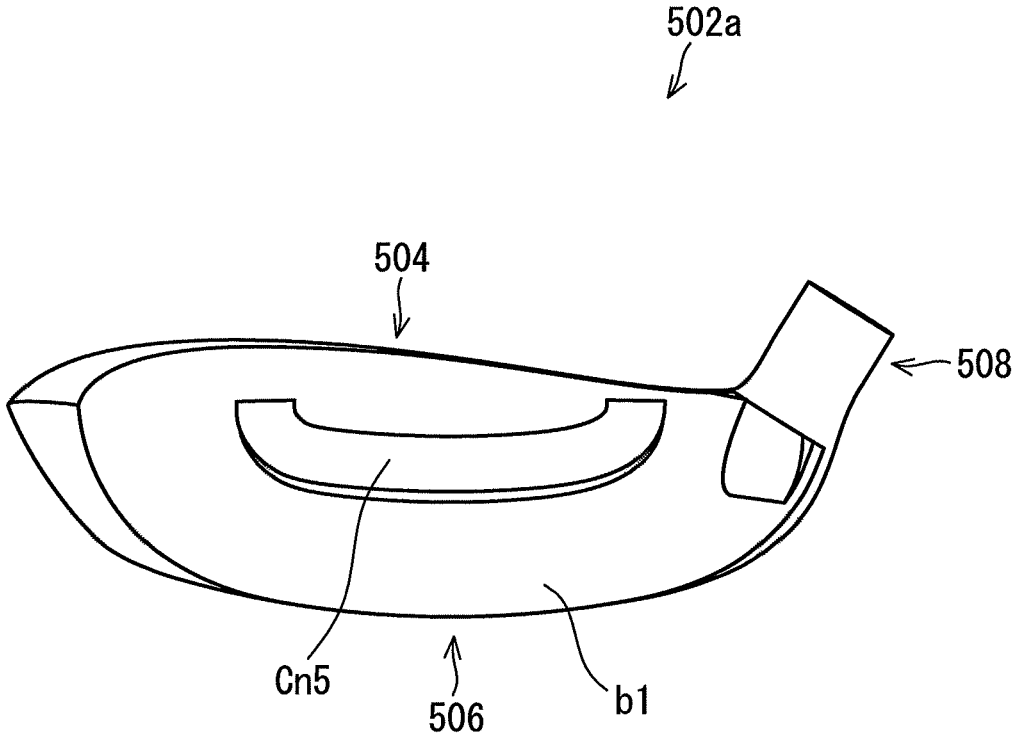
FIG. 24 is a front view of a face-removed head in which a face part is removed from the head in FIG. 22.

FIG. 22 is a perspective view of a golf club head 502 according to a referential example. FIG. 23 is a bottom view of the head 502 as viewed from below. FIG. 24 is a front view of a face-removed head 502*a* in which a face part Fp5 is removed from the head 502.

The head 502 is a wood type head. The head 502 is a fairway wood type head. The head 502 includes a head body h5, the face part Fp5, and a connecting part Cn5. The connecting part Cn5 connects a front face b1 of the head body h5 and a face rear surface f2 of the face part Fp5. The inside of the head body h5 is an empty space.

The head body h5 includes a crown 504, a sole 506, and a hosel 508. The hosel 508 includes a hosel hole 510. A part of the crown 504 is constituted by a lid member 504*a*.

The head 502 is different from the heads 2, 102, 202 and 302 in shape of the connecting part.

As shown in FIG. 24, the connecting part Cn5 connects an upper portion of the face part Fp5 (face rear surface f2) and an upper portion of the head body h5 (front face b1). The extending direction of the connecting part Cn5 does not incline with respect to the face perpendicular direction. Deformation of the connecting part Cn5 at impact is limited.

Meanwhile, the heads 2, 102, 202, and 302 each include the connecting parts which tend to be deformed. Such deformability depends on their inclination portions. A force applied on the head by a ball at impact acts in a direction that is substantially parallel to the face perpendicular direction. Because of the presence of the inclination portion which extends while inclining with respect to the face perpendicular direction D1, the deformation of the connecting part which is caused by the force applied from a ball is facilitated. That is, the connecting part has a low rigidity against the force applied from a ball. For this reason, the connecting part tends to be deformed at impact. The elastic deformation of the connecting part itself enhances rebound performance.

In the referential example, the elastic deformation of the connecting part Cn5 itself is limited. JP2015-192781A (US2015/0273286A1) also discloses embodiments in which the elastic deformation of the connecting part itself is limited. On the other hand, in the above embodiments of the present application, the presence of the inclination portion enlarges the elastic deformation of the connecting part itself. The elastic deformation of the connecting part itself further enhances rebound performance. The rebound performance of a region that is backed up by the connecting part is particularly improved.

Figures 25A, 25B, 25C:
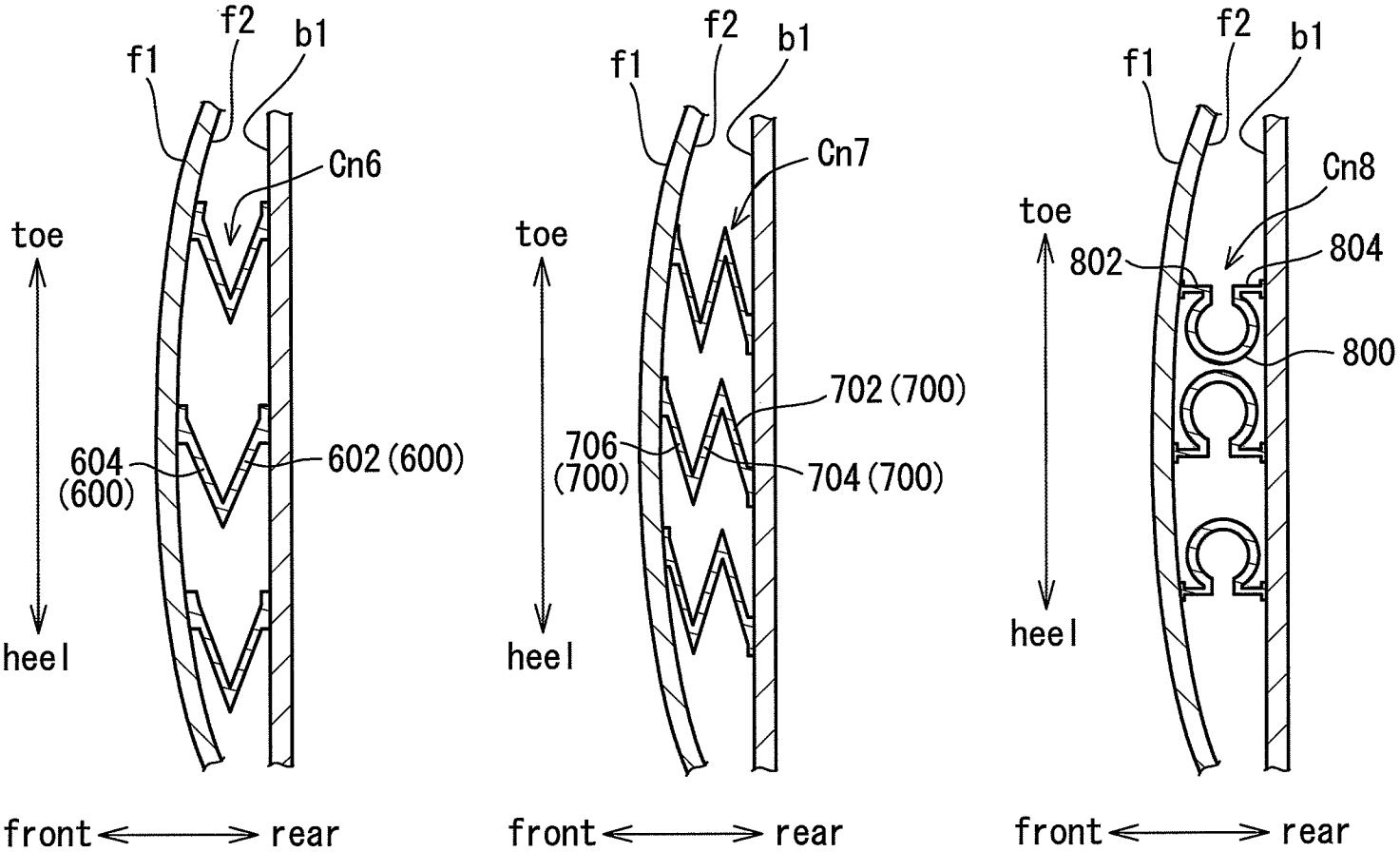
FIG. 25A, FIG. 25B and FIG. 25C are cross-sectional views showing modification examples of the connecting part.

FIGS. 25A, 25B and 25C are cross-sectional views showing modification examples of the connecting part. These are cross-sectional views taken along the face perpendicular direction.

The embodiment of FIG. 25A includes three connecting parts Cn6. Each connecting part Cn6 includes an inclination portion 600. The inclination portion 600 includes a first inclination portion 602 extending from the front face b1 of the front portion and inclining so as to go toward the heel side as it approaches the face part, and a second inclination portion 604 extending from a front end of the first inclination portion 602 to the face rear surface f2 and inclining so as to go toward the toe side as it approaches the face part. The first inclination portion 602 and the second inclination portion 604 incline with respect to the face perpendicular direction. The first inclination portion 602 and the second inclination portion 604 are inclined inversely to each other. The first inclination portion 602 includes a straight inclination portion that extends along a straight line. The second inclination portion 604 includes a straight inclination portion that extends along a straight line.

The embodiment of FIG. 25B includes three connecting parts Cn7. Each connecting part Cn7 includes an inclination portion 700. The inclination portion 700 includes a first inclination portion 702 extending from the front face b1 of the front portion and inclining so as to go toward the toe side as it approaches the face part, a second inclination portion 704 extending from a front end of the first inclination portion 702 toward the face rear surface f2 and inclining so as to go toward the heel side as it approaches the face part, and a third inclination portion 706 extending from a front end of the second inclination portion 704 to the face rear surface f2 and inclining so as to go toward the toe side as it approaches the face part. The first inclination portion 702, the second inclination portion 704 and the third inclination portion 706 incline with respect to the face perpendicular direction. The first inclination portion 702 and the second inclination portion 704 are inclined inversely to each other. The second inclination portion 704 and the third inclination portion 706 are inclined inversely to each other. The first inclination portion 702 includes a straight inclination portion that extends along a straight line. The second inclination portion 704 includes a straight inclination portion that extends along a straight line. The third inclination portion 706 includes a straight inclination portion that extends along a straight line.

The embodiment of FIG. 25C includes three connecting parts Cn8. Each connecting part Cn8 includes a cylindrical portion 800 having a cross-sectional shape of a circular arc, a face joint portion 802 connecting one end of the cylindrical portion 800 and the face rear surface f2, and a body joint portion 804 connecting the other end of the cylindrical portion 800 and the front face b1 of the front portion. The cylindrical portion 800 inclines with respect to the face perpendicular direction except a peak portion thereof. That is, substantially the entirety of the cylindrical portion 800 is the inclination portion. The cylindrical portion 800 includes a first inclination portion and a second inclination portion that are inclined inversely to each other.

Figure 26:
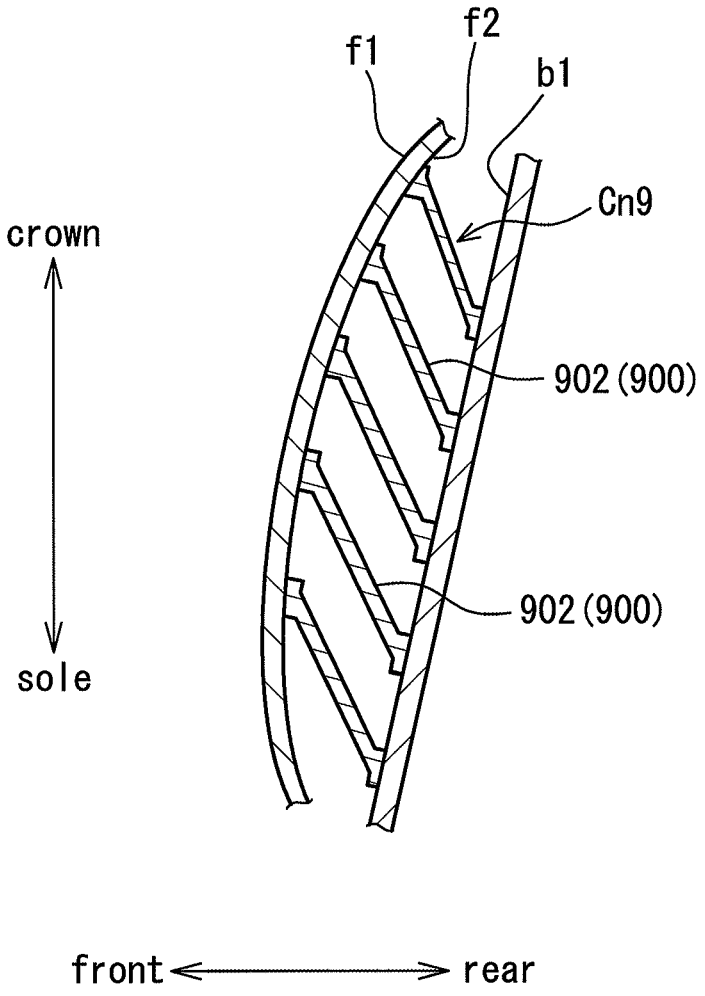
FIG. 26 is a cross-sectional view showing a modification example of the connecting part.

FIG. 26 is a cross-sectional view showing another modification example. The embodiment of FIG. 26 includes five connecting parts Cn9. Each connecting part Cn9 includes an inclination portion 900. The inclination portion 900 includes a straight inclination portion 902 extending along a straight line. The inclination portion 900 of the connecting part Cn9 is constituted by only the straight inclination portion 902. The inclination portion 900 inclines so as to go upward as it approaches the face part. The straight inclination portion 902 tends to be deformed by the force applied from a ball at impact. The elastic deformation of the straight inclination portion 902 contributes to improvement in rebound performance.

The following is further explanations for the connecting parts of the respective embodiments.

The following terms are defined for the connecting parts in the present application.

[Axis Line of Connecting Part]

Each connecting part has a center of gravity. There are myriads of straight lines passing through the center of gravity of the connecting part. Of the straight lines, a straight line that satisfies a sameness of cross sections is defined as the axis line of the connecting part.

[Sameness of Cross Sections]

An arbitrary straight line passing through the center of gravity of the connecting part has a large number of planes perpendicular to the straight line. These planes determine cross sections of the connecting part. That is, a large number of cross sections are determined for each straight line. When all the cross sections of one straight line are the same, or when a cross-section overlapping ratio is greater than or equal to X %, the straight line is defined as satisfying the sameness of cross sections. This X is 70, preferably 80, and more preferably 90. When all the cross sections are the same, the cross-section overlapping ratio is 100%. When the number of the straight lines satisfying the sameness of cross sections is two or more, one of the straight lines which has the maximum cross-section overlapping ratio is defined as the axis line.

[Cross-Section Overlapping Ratio]

Two cross sections perpendicular to the axis line are superposed on each other to obtain a superposed diagram. In the superposed diagram, the area of an overlapping portion of the two cross sections is defined as M1, and the total area occupied by the two superposed cross sections is defined as M2.

The cross-section overlapping ratio (%) can be calculated by the following formula:

$$\text{Cross-Section Overlapping Ratio}=(M1/M2)\times 100$$

Of the large number of cross sections, a pair of cross sections whose cross-section overlapping ratio is the minimum is selected as the two cross sections used for the superposed diagram.

Figure 27:
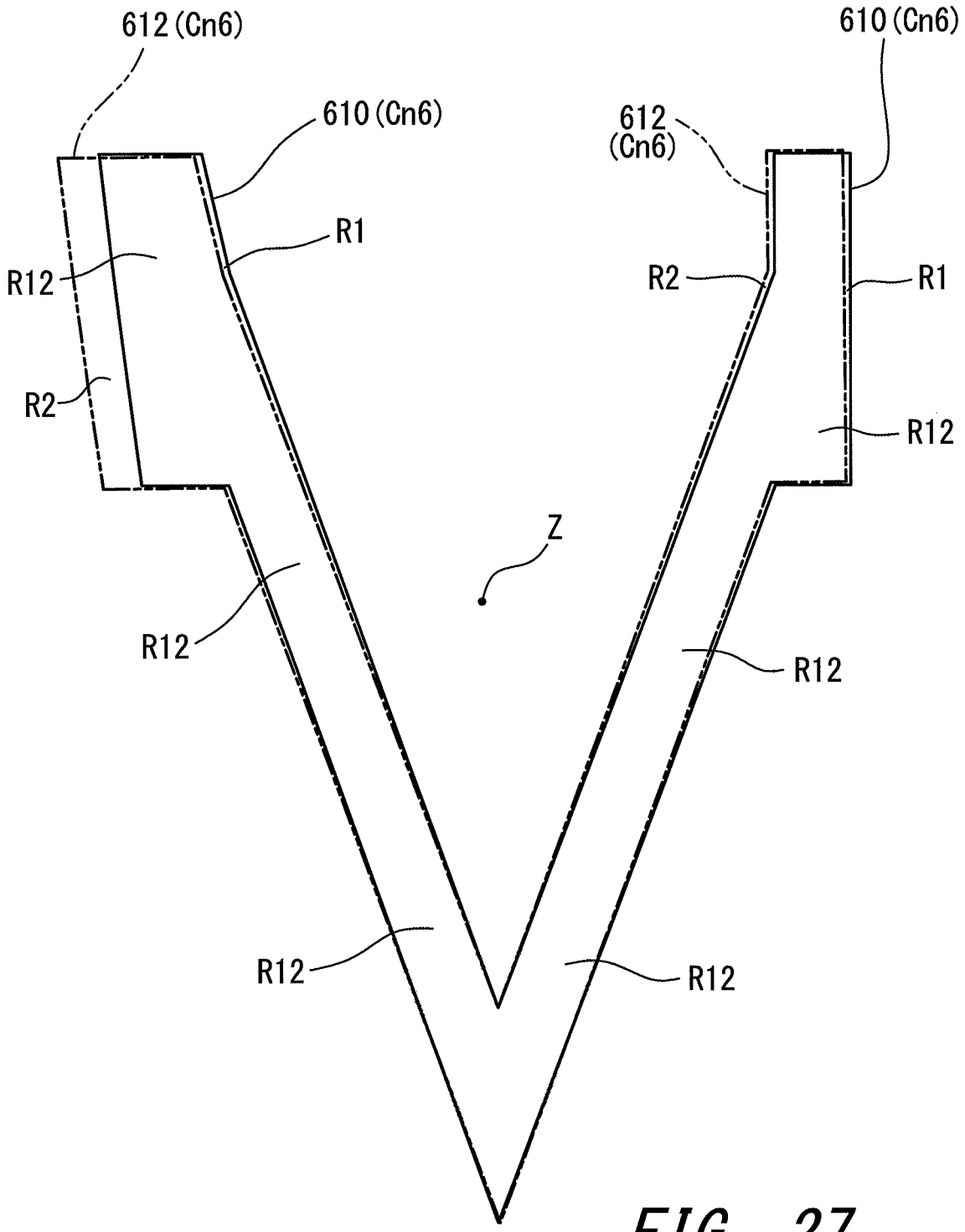
FIG. 27 is a diagram for illustrating a sameness of cross sections.

FIG. 27 shows an example of the superposed diagram. The superposed diagram shows the connecting part Cn6 shown in FIG. 25A. The solid line shows a contour line 610 of a first cross section of the connecting part Cn6. The two-dot chain line shows a contour line 612 of a second cross section of the connecting part Cn6. The above M1 is an area of a region surrounded by both the contour line 610 and the contour line 612. The above M2 is an area of a region surrounded by an outer contour line of the contour line 610 or the contour line 612. That is, M2 includes not only a region R12 constituting the area M1 but also a region R1 surrounded by only the contour line 610 and a region R2 surrounded by only the contour line 612. FIG. 27 shows the axis line by using reference sign Z.

For obtaining the superposed diagram, the cross sections are superposed on each other without being displaced or rotated. Each cross section includes a point that is the cross section of the axis line. In the superposed diagram, the axis line Z (a point) included in the first section coincides with the axis line Z (a point) included in the second section (see FIG. 27).

[Length of Face Part Measured Along Axis Line]

FIG. 6 shows the axis lines Z of the respective connecting parts Cn1 by using one-dot chain line. The length of the face part Fp1 can be measured along the axis lines Z. This length is measured for each connecting part Cn1. In the embodiment of FIG. 6, the connecting part Cn11 located on the most toe side has an axis line Z1. The connecting part Cn12 located on the most heel side has an axis line Z2. The connecting part Cn13 located between the connecting part Cn11 and the connecting part Cn12 has an axis line Z3. As to the connecting part Cn11, the length of the face part Fp1 is measured along the axis line Z1. As to the connecting part Cn12, the length of the face part Fp1 is measured along the axis line Z2. As to the connecting part Cn13, the length of the face part Fp1 is measured along the axis line Z3. FIG. 6 shows a length Lf1 of the face part Fp1 which is measured along the axis line Z1 of the connecting part Cn11. Measurement position for measuring the length is determined in the projection image projected to the face projection plane. In the projection image, the length of the face part Fp1 along the axis line Z1 is measured at a position where the axis line Z1 intersects the face part Fp1 (see FIG. 6).

[Cross-Section Symmetry]

When the cross section of the connecting part is substantially symmetrical, the connecting part is defined as having cross-section symmetry. An indicator used for determining the word "substantially" is a symmetric overlapping ratio that is described later. When the symmetric overlapping ratio is greater than or equal to Y %, the cross section is defined as substantially having the cross-section symmetry. Y is 70, more preferably 80 and still more preferably 90. A cross section on which the cross-section symmetry is determined can be a cross section perpendicular to the axis line Z. There are a large number of cross sections perpendicular to the axis line Z, and all the large number of cross sections preferably have the cross-section symmetry.

[Symmetric Overlapping Ratio]

The symmetric overlapping ratio is an indication showing the degree of resemblance between the original diagram of the cross section of the connecting part and a symmetric diagram obtained from the original diagram. For obtaining the symmetric overlapping ratio, the original diagram and the symmetric diagram are superposed on each other to prepare a symmetrically superposed diagram. The symmetric diagram is determined based on the type of symmetry (type of cross-section symmetry) of the cross section. For example, when the type of the cross-section symmetry of the cross section is line symmetry, the symmetric diagram is obtained by reversing the original diagram about the line of symmetry. For example, when the type of the cross-section symmetry of the cross section is point symmetry, the symmetric diagram is obtained by rotating the original diagram through 180 degrees about the point of symmetry. The area of an overlapping portion between the original diagram and the symmetric diagram is denoted by S1, and a total area of a portion occupied by the two superposed diagrams is denoted by S2, then the symmetric overlapping ratio (%) can be calculated by the following formula:

$$\text{Symmetric Overlapping ratio}=(S1/S2)\times 100$$

When the cross section has a perfect symmetry, the symmetric overlapping ratio is 100%.

Figure 28:
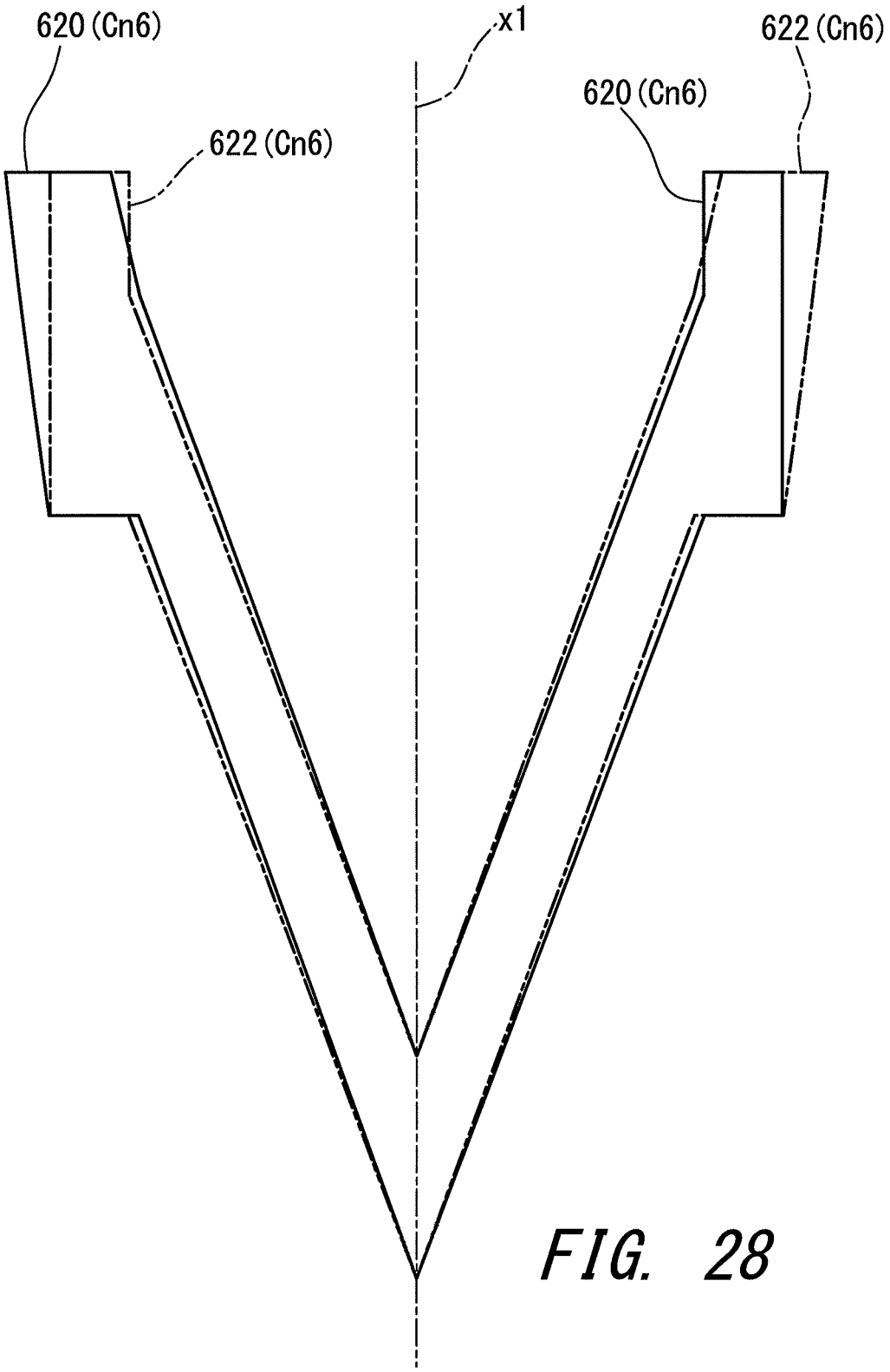
FIG. 28 is a diagram for illustrating a cross-section symmetry.

FIG. 28 shows an example of the symmetrically superposed diagram. This symmetrically superposed diagram shows the connecting part Cn6 shown in FIG. 25A. A original diagram 620 of the cross section of the connecting part Cn6 is shown by using a solid line, and a symmetric diagram 622 obtained from the original diagram 620 is shown by using two-dot chain lines. S1 in the above formula is the area of a region that is surrounded by both the original diagram 620 and the symmetric diagram 622. S2 in the above formula is the area of a region that is surrounded by an outer contour of the original diagram 620 or the symmetric diagram 622. FIG. 28 shows an axis x1 of symmetry by using one-dot chain line.

Note that the axis of symmetry or the point of symmetry can be determined such that the symmetric overlapping ratio becomes maximum.

As described above, the presence of the inclination portion facilitates the deformation of the connecting part at impact. The elastic deformation of the connecting part contributes to improvement in rebound performance. The inclination portion preferably extends while inclining with respect to the face perpendicular direction in a cross section parallel to the horizontal plane HP and/or in a cross section perpendicular to the horizontal plane HP and parallel to the front-rear direction.

A preferable example of the inclination portion is a straight inclination portion that extends along a straight line. The straight inclination portion is included in the connecting part Cn6 shown in FIG. 25A, the connecting part Cn7 shown in FIG. 25B, and a connecting part Cn9 shown in FIG. 26. The straight inclination portion can enhance the deformability of the connecting part.

Another preferable example of the inclination portion is an arc inclination portion that extends along a circular arc. The arc inclination portion is included in the connecting part Cn1, the connecting part Cn2, the connecting part Cn3 and the connecting part Cn4. The arc inclination portion is also included in the connecting part Cn8 in FIG. 25C. The arc inclination portion can improve the deformability of the connecting part.

Another preferable inclination portion includes a first inclination portion and a second inclination portion that are inclined inversely to each other. The connecting part Cn1, the connecting part Cn2, the connecting part Cn3, the connecting part Cn4 and the connecting part Cn8 each have a circular arc shape, and thus each include the first inclination portion and the second inclination portion which are inclined inversely to each other. The connecting part Cn6 shown in FIG. 25A and the connecting part Cn7 shown in FIG. 25B also each include the first inclination portion and the second inclination portion which are inclined inversely to each other. The two inclination portions which are inclined inversely to each other can improve the deformability of the connecting part.

The connecting part may have the cross-section symmetry. Examples of the type of the cross-section symmetry include line symmetry, point symmetry, and rotational symmetry. The connecting part may have the cross-section symmetry in a cross section that is parallel to the horizontal place HP. Alternatively, the connecting part may have the cross-section symmetry in a cross section that is perpendicular to the horizontal plane HP and parallel to the front-rear direction.

In all the above-described embodiments, the connecting parts have a cross-section symmetry. Of all the embodiments, embodiments in which the type of the cross-section symmetry in the cross section perpendicular to the axis line Z is the line symmetry is the connecting part Cn1, the connecting part Cn2, the connecting part Cn3, the connecting part Cn4, the connecting part Cn6 and the connecting part Cn8. Embodiments in which the type of the cross-section symmetry is the point symmetry is the connecting part Cn1, the connecting part Cn2, the connecting part Cn7 and the connecting part Cn9.

The cross-section symmetry can improve the deformability of the connecting part.

Figure 29A:
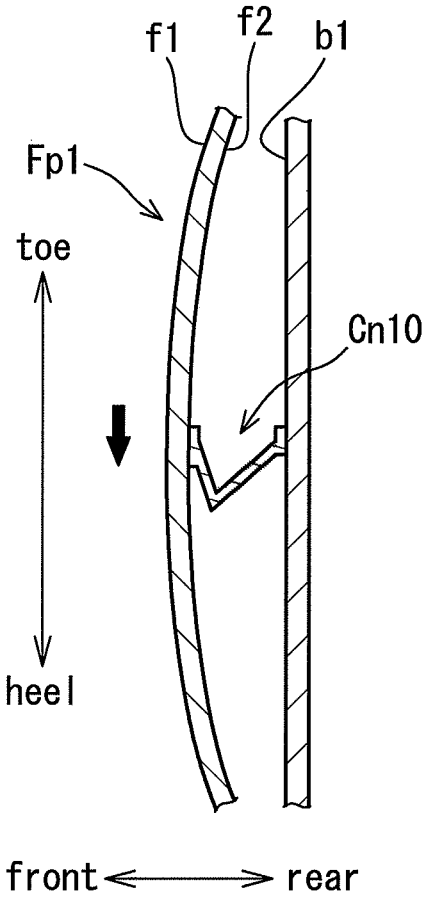
FIG. 29A and FIG. 29B are cross-sectional views for illustrating effects of the cross-section symmetry.
Figure 29B:
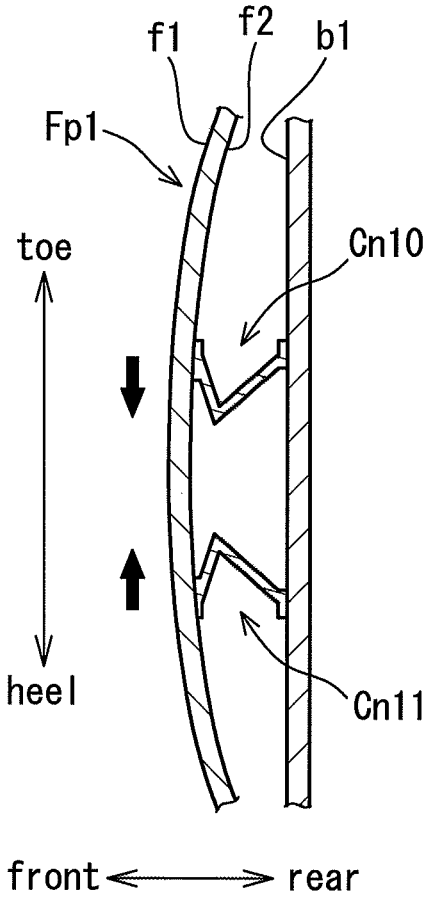

FIG. 29A and FIG. 29B are cross-sectional views for illustrating effects brought by the cross-section symmetry.

The embodiment of FIG. 29A includes a single connecting part Cn10 which does not have a cross-section symmetry. The connecting part Cn10 is compressed in the front-rear direction at impact. This compressive deformation in the front-rear direction of the connecting part Cn10 displaces the face part Fp1 toward the heel side.

The embodiment of FIG. 29B includes two connecting parts Cn10 and Cn11 which do not have a cross-section symmetry. The connecting part Cn10 tends to displace the face part Fp1 toward the heel side when compressively deformed in the front-rear direction. Meanwhile, the connecting part Cn11 tends to displace the face part Fp1 toward the toe side when compressively deformed in the front-rear direction. In this condition, a force acting toward the toe side and a force acting toward the heel side function evenly in opposite directions. As a result, the connecting part Cn10 and the connecting part Cn11 are restrained from deforming. When the connecting parts each have the cross-section symmetry, such deformation restraint between the connecting parts is suppressed, whereby the deformation of the connecting parts is facilitated.

The connecting part preferably includes the axis line Z which passes through the center of gravity of the connecting part and satisfies the sameness of cross sections. In all the above-described embodiments, each connecting part includes the axis line Z.

The axis line Z of each connecting part preferably passes through (penetrates) the gap between the face part and the head body. That is, the axis line Z preferably does not intersect the face part and does not intersect the head body. In this case, the axis line Z extends substantially parallel to the face part. Therefore, the sameness of cross sections enables the connecting part to be deformed always in the same manner at impact even if a ball is struck at any location of the striking face f1. As a result, variations in deformation of the connecting part caused by difference of striking points are suppressed as well as the deformation of the connecting part is facilitated.

The connecting part preferably has a length measured along the axis line Z of greater than or equal to 20% of the length of the face part measured along the same axis line Z.

Increase in the ratio of the lengths facilitates the transmitting of the force applied at impact from a ball to the connecting part, thereby promoting the deformation of the connecting part in the front-rear direction. In this respect, the ratio of the lengths is preferably greater than or equal to 30%, more preferably greater than or equal to 40%, and still more preferably greater than or equal to 50%. As with the connecting part Cn1 and the connecting part Cn3, the ratio of the lengths may be 100%. Decrease in the ratio of the lengths can selectively enlarge a face region that is not backed up by the connecting part. In this case, as with the head 102 (connecting part Cn2) and the head 302 (connecting part Cn4) for example, rebound performance exhibited when a ball is struck at the lower portion can be enhanced. In light of selectively providing a high rebound area, the ratio of the lengths may be less than or equal to 70%, may be less than or equal to 60%, or may be less than or equal to 50%.

In a club (such as driver type) that mainly used for striking a ball that is teed up, striking points are likely to be distributed to the whole face. Meanwhile, in a club (such as fairway wood type, and utility type) mainly used for striking a ball that is placed directly on the ground (lawn), striking points are likely to concentrate in the lower portion of the face. When striking points are likely to concentrate in the lower portion of the face, it is preferable to decrease the ratio of the lengths, to provide the face region in which the lower portion of the face part is not backed up by the connecting part, and to enhance the rebound performance exhibited when a ball is struck at the lower portion.

As described above, the deformation of the connecting part itself enhances rebound performance. In this respect, the connecting part has a thickness of preferably less than or equal to 5 mm, more preferably less than or equal to 4 mm, still more preferably less than or equal to 3 mm, and yet still more preferably less than or equal to 2 mm. In light of strength, the thickness of the connecting part is greater than or equal to 0.3 mm, more preferably greater than or equal to 0.4 mm, and still more preferably greater than or equal to 0.5 mm.

As described above, the deformation of the connecting part itself enhances rebound performance. In this respect, the thickness of the connecting part in the cross section parallel to the horizontal plane HP is preferably less than or equal to 5 mm, more preferably less than or equal to 4 mm, still more preferably less than or equal to 3 mm, and yet still more preferably less than or equal to 2 mm. In light of strength, the thickness of the connecting part in the cross section parallel to the horizontal plane HP is preferably greater than or equal to 0.3 mm, more preferably greater than or equal to 0.4 mm, and still more preferably greater than or equal to 0.5 mm.

In light of rebound performance, the face part has a thickness of preferably less than or equal to 5 mm, and more preferably less than or equal to 4 mm. In light of strength, the thickness of the face part is preferably greater than or equal to 1.0 mm, more preferably greater than or equal to 1.5 mm, still more preferably greater than or equal to 1.8 mm, and yet still more preferably greater than or equal to 2 mm. The face part may have a constant thickness or an inconstant thickness.

Deformation of the front portion of the head body also contributes to rebound performance. In light of enhancing rebound performance, the front portion of the head body has a thickness of preferably less than or equal to 5 mm, more preferably less than or equal to 4 mm, still more preferably less than or equal to 3 mm, still more preferably less than or equal to 2.8 mm, still more preferably less than or equal to 2.6 mm, still more preferably less than or equal to 2.4 mm, still more preferably less than or equal to 2.2 mm, and yet still more preferably less than or equal to 2 mm. In light of strength, the thickness of the front portion of the head body is preferably greater than or equal to 1 mm, more preferably greater than or equal to 1.2 mm, still more preferably greater than or equal to 1.5 mm, still more preferably greater than or equal to 1.7 mm, and yet still more preferably greater than or equal to 1.9 mm.

In light of allowing the connecting part and the face part to be deformed, a distance between the front face of the head body and the face rear surface is preferably greater than or equal to 0.2 mm, more preferably greater than or equal to 0.5 mm, and still more preferably greater than or equal to 1.0 mm. In light of a suitable face progression, the distance between the front face of the head body and the face rear surface is preferably less than or equal to 10 mm, more preferably less than or equal to 8 mm, and still more preferably less than or equal to 6 mm. This distance is measured along the front-rear direction. The distance may be constant or inconstant.

The material of the connecting part is not limited. Examples of the material of the connecting part include a metal and CFRP (carbon fiber reinforced plastic). Examples of the metal include one or more metals selected from soft iron, pure titanium, a titanium alloy, a stainless steel, maraging steel, an aluminum alloy, a magnesium alloy, and a tungsten-nickel alloy. Specific examples of the stainless steel include SUS630 and SUS304. Specific examples of the titanium alloy include 6-4 titanium (Ti-6Al-4V), Ti-15V-3Cr-3Sn-3Al, and Ti-6-22-22S. The material of the connecting part is preferably capable of being welded to the face part. The material of the connecting part may be the same as the material of the face part. The material of the connecting part is preferably capable of being welded to the head body. The material of the connecting part may be the same as the material of (the front portion of) the head body.

The material of the head body is not limited. Examples of the material of the head body include a metal and CFRP (carbon fiber reinforced plastic). Examples of the metal include one or more metals selected from soft iron, pure titanium, a titanium alloy, a stainless steel, maraging steel, an aluminum alloy, a magnesium alloy, and a tungsten-nickel alloy. Specific examples of the stainless steel include SUS630 and SUS304. Specific examples of the titanium alloy include 6-4 titanium (Ti-6Al-4V), Ti-15V-3Cr-3Sn-3Al, and Ti-6-22-22S. The soft iron means a low-carbon steel having a carbon content of less than 0.3 wt %. The material of the head body is preferably capable of being welded to the connecting part. The material of the head body may be the same as the material of the connecting part.

The material of the face part is not limited. Examples of the material of the face part include a metal and CFRP (carbon fiber reinforced plastic). Examples of the metal include one or more metals selected from soft iron, pure titanium, a titanium alloy, a stainless steel, maraging steel, an aluminum alloy, a magnesium alloy, and a tungsten-nickel alloy. Specific examples of the stainless steel include SUS630 and SUS304. Specific examples of the titanium alloy include 6-4 titanium (Ti-6Al-4V), Ti-15V-3Cr-3Sn-3Al, and Ti-6-22-22S. The material of the face part is preferably capable of being welded to the connecting part. The material of the face part may be the same as the material of the connecting part.

The face part may be made of a rolled material. The rolled material has few defects, and has an excellent strength. The face part may be made of a forged material. The forged material has few defects, and has an excellent strength.

One example of a preferable head is a driver type head. The driver means a number 1 wood (W #1). A high flight-distance performance is required for the drivers. The present disclosure is thus preferably applied to the driver type head. The driver type head normally has the following structures.

(1*a*) curved striking face (1*b*) hollow portion (1*c*) volume of 300 cc or greater and 460 cc or less (1*d*) real loft angle of 7 degrees or greater and 14 degrees or less Another example of a preferable head is a fairway wood type head. Examples of the fairway wood includes a number 3 wood (W #3), a number 4 wood (W #4), a number 5 wood (W #5), a number 7 wood (W #7), a number 9 wood (W #9), a number 11 wood (W #11) and a number 13 wood (W #13). The fairway wood type head normally has the following structures.

(2*a*) curved striking face (2*b*) hollow portion (2*c*) volume of 100 cc or greater and less than 300 cc (2*d*) real loft angle of greater than 7 degrees and less than or equal to 33 degrees The fairway wood type head has a volume of more preferably 100 cc or greater and 200 cc or less.

The fairway wood type head is smaller than the driver type head. A small head includes a striking face having a small area. It is difficult to enhance rebound performance of a small striking face when using conventional structures. The above-described structures are effective in enhancement of rebound performance for a small striking face.

The fairway woods are often used for striking a ball that is placed on the ground (lawn). In other words, the fairway woods are often used for striking a ball that is not teed up. Therefore, when the fairway woods are used, the ball is often struck with the lower portion of the striking face. As shown in the head 102 and the head 302, the presence of the connecting part can enhance rebound performance exhibited when striking with the lower portion.

Another example of a preferable head is a hybrid type head. The hybrid type head normally includes the following structures.

(3*a*) curved striking face (3*b*) hollow portion (3*c*) volume of 100 cc or greater and 200 cc or less (3*d*) real loft angle of 15 degrees or greater and 33 degrees or less The hybrid type head has a volume of more preferably 100 cc or greater and 150 cc or less.

The hybrid type head is smaller than the driver type head. In conventional structures, a small striking face has a small amount of bending. The above-described structures are effective in enhancement of rebound performance for a small striking face.

The hybrid-type clubs are often used for striking a ball that is placed on the ground (lawn). In other words, the hybrid-type clubs are often used for striking a ball that is not teed up. Therefore, when the hybrid-type clubs are used, the ball is often struck with the lower portion of the striking face. As described above, the presence of the connecting part can enhance rebound performance exhibited when striking with the lower portion.

The fairway wood type head normally has a smaller striking area as compared with a driver type head. For this reason, the deformation of the face at impact might not be sufficiently attained in the fairway wood type head. This is also true for utility type heads, hybrid type heads, and iron type heads. The above-described structures can effectively enhance rebound performance also in heads having a small striking area. In this respect, the head volume is preferably less than or equal to 300 cc, more preferably less than 300 cc, still more preferably less than or equal to 280 cc, and yet still more preferably less than or equal to 260 cc. The rebound performance and the flight distance are considered to be particularly important in wood type clubs and hybrid type clubs. In this respect, the head volume is preferably greater than or equal to 100 cc.

EXAMPLES

Hereinafter, the effects of the present disclosure will be clarified by Examples. However, the present disclosure should not be interpreted in a limited way based on the description of Examples.

Example 1

An FEM model of a head of Example 1 was prepared. The structures of the head were the same as the head 2 according to the first embodiment. The connecting part Cn1 located on the toe side and the connecting part Cn1 located on the heel side each included the cylindrical portion 20 having an inner diameter of 9 mm. The connecting part Cn1 located on the middle included the cylindrical portion 20 having an inner diameter of 9.6 mm. In all the connecting parts Cn1, the cylindrical portions 20 had a thickness of 0.5 mm. In all the connecting parts Cn1, the length of each connecting part Cn1 measured along its axis line Z was the same as the length of the face part Fp1 measured along the same axis line Z. Properties of materials were as follows, which were set on the assumption that the head was made of stainless steel.

Elastic Modulus: 210 GPa

Poisson's Ratio: 0.3

Density: 7.8 g/cm$^3$

The obtained FEM model was used to perform simulations in which balls were collided against the head. The Simulations were performed while changing a location (striking point) at which the ball was collided against the head. During the simulations, a natural frequency and a coefficient of restitution (COR) were calculated for each striking point. The results are shown in Table 1 below.

The natural frequency at each striking point was calculated under the condition that a region falling within 5 mm from the striking point was fixed. The natural frequency is highly correlated to the coefficient of restitution at the same striking point.

Table 1 below shows striking points on the striking face by using the x-coordinate and the y-coordinate. As described above, the origin of the x-y coordinate system, at which the x-coordinate is 0.0 mm and the y-coordinate is 0.0 mm, is the face center.

Example 2

Simulations for Example 2 were performed in the same manner as in Example 1 except that the structures of the head were the same as the head 102 according to the second embodiment. Example 1 was different from Example 2 in only length of the connecting parts and thickness of the connecting parts. In Example 2, the length of each connecting part Cn2 measured along its axis line Z was 50% of the length of the face part Fp2 measured along the same axis line Z. In Example 2, the thickness of the connecting parts was 1.0 mm. The results of the simulations are shown in Table 1 below.

Example 3

Simulations for Example 3 were performed in the same manner as in Example 1 except that the structures of the head were the same as the head 202 according to the third embodiment. Example 3 was different from Example 1 in that the respective connecting parts were divided into two equal parts along their axis lines Z and the divided connecting parts were arranged with spaces therebetween. The length of each connecting part Cn3 measured along the axis line Z was the same as the length of the face part Fp3 measured along the same axis line Z. The results of the simulations are shown in Table 1 below.

Example 4

Simulations for Example 4 were performed in the same manner as in Example 2 except that the structures of the head were the same as the head 302 according to the fourth embodiment. Example 4 was different from Example 2 in that the respective connecting parts were divided into two equal parts along their axis lines Z and the divided connecting parts were arranged with spaces therebetween. The results of the simulations are shown in Table 1 below.

Comparative Example

Simulations for Comparative Example were Performed in the same manner as in Example 1 except that the structures of the head were the same as the head 502 according to the referential example. Comparative Example was different from Example 1 in only shape of the connecting parts. The results of the simulations are shown in Table 1 below.

TABLE 1

Results of Evaluations for Examples and Comparative Example

| | Striking Point | | Natural | |
|---|---|---|---|---|
| | x-coordinate (mm) | y-coordinate (mm) | Frequency (Hz) | COR |
| Example 1 | 0.0 | 0.0 | 1469 | 0.8828 |
| | 0.0 | 5.0 | 1436 | 0.8951 |
| | 0.0 | 10.0 | 1362 | 0.9020 |
| | 0.0 | −5.0 | 1458 | 0.8642 |
| | 0.0 | −10.0 | 1414 | 0.8442 |
| | 10.0 | 0.0 | 1531 | 0.8651 |
| | 20.0 | 0.0 | 1486 | 0.8251 |
| | −10.0 | 0.0 | 1677 | 0.8588 |
| | −20.0 | 0.0 | 1658 | 0.8067 |
| Example 2 | 0.0 | 0.0 | 1665 | 0.8826 |
| | 0.0 | 5.2 | 1739 | 0.8835 |
| | 0.0 | 10.4 | 1746 | 0.8835 |
| | 0.0 | −5.2 | 1393 | 0.8735 |
| | 0.0 | −10.3 | 1181 | 0.8565 |
| | 10.0 | 0.0 | 1668 | 0.8658 |
| | 20.0 | 0.2 | 1664 | 0.8217 |
| | −10.0 | 0.0 | 1591 | 0.8612 |
| | −20.0 | 0.2 | 1585 | 0.8132 |
| Example 3 | 0.0 | 0.0 | 1512 | 0.8834 |
| | 0.0 | 5.2 | 1474 | 0.8956 |
| | 0.0 | 10.4 | 1392 | 0.9021 |
| | 0.0 | −5.2 | 1502 | 0.8646 |
| | 0.0 | −10.3 | 1446 | 0.8436 |
| | 10.0 | 0.0 | 1571 | 0.8669 |
| | 20.0 | 0.2 | 1540 | 0.8263 |
| | −10.0 | 0.0 | 1700 | 0.8592 |

TABLE 1-continued

Results of Evaluations for Examples and Comparative Example

| | Striking Point | | Natural | |
|---|---|---|---|---|
| | x-coordinate (mm) | y-coordinate (mm) | Frequency (Hz) | COR |
| | −20.0 | 0.2 | 1715 | 0.8084 |
| Example 4 | 0.0 | 0.0 | 1666 | 0.8812 |
| | 0.0 | 5.2 | 1771 | 0.8824 |
| | 0.0 | 10.4 | 1799 | 0.8819 |
| | 0.0 | −5.2 | 1465 | 0.8735 |
| | 0.0 | −10.3 | 1178 | 0.8584 |
| | 10.0 | 0.0 | 1692 | 0.8648 |
| | 20.0 | 0.2 | 1686 | 0.8189 |
| | −10.0 | 0.0 | 1621 | 0.8611 |
| | −20.0 | 0.2 | 1607 | 0.8150 |
| Comparative Example | 0.0 | 0.0 | 2485 | 0.8687 |
| | 0.0 | 5.2 | 2524 | 0.8753 |
| | 0.0 | 10.4 | 2372 | 0.8806 |
| | 0.0 | −5.2 | 2245 | 0.8555 |
| | 0.0 | −10.3 | 1747 | 0.8380 |
| | 10.0 | 0.0 | 2762 | 0.8516 |
| | 20.0 | 0.2 | 2836 | 0.8029 |
| | −10.0 | 0.0 | 2292 | 0.8494 |
| | −20.0 | 0.2 | 2122 | 0.8014 |

As shown in Table 1, Comparative Example was evaluated as having high natural frequencies in general, and having particularly high natural frequencies in the central portion of the face. For this reason, coefficients of restitution (COR) in the central portion of the face were low. On the other hand, Examples 1 to 4 had lower natural frequencies in the central portion of the face and had higher coefficients of restitution in the central portion of the face. These results show improvements in coefficients of restitution by the deformation of the connecting parts. In comparison between Example 1 and Example 2, Example 2 in which the connecting parts were absent in the lower portion of the face had lower natural frequencies at lower striking points and had higher coefficients of restitution at the lower striking points. Similarly, in comparison between Example 3 and Example 4, Example 4 in which the connecting parts were absent in the lower portion of the face had lower natural frequencies at lower striking points and had higher coefficients of restitution at the lower striking points. Thus, advantages of the present disclosure are clear.

The following clauses are disclosed regarding the above-described embodiment.

[Clause 1]

A golf club head comprising:

a head body;

a face part located apart from the head body; and a plurality of connecting parts that extend between the head body and the face part, wherein each connecting part includes an inclination portion that extends while inclining with respect to a face perpendicular direction.

[Clause 2]

The golf club head according to clause 1, wherein the inclination portion includes a straight inclination portion that extends along a straight line.

[Clause 3]

The golf club head according to clause 1 or 2, wherein the inclination portion includes an arc inclination portion that extends along a circular arc.

[Clause 4]

The golf club head according to any one of clauses 1 to 3, wherein the inclination portion includes a first inclination portion and a second inclination portion that are inclined inversely to each other.

[Clause 5]

The golf club head according to any one of clauses 1 to 4, wherein the plurality of connecting parts each have a cross-section symmetry.

[Clause 6]

The golf club head according to clause 5, wherein the cross-section symmetry is a line symmetry.

[Clause 7]

The golf club head according to clause 5, wherein the cross-section symmetry is a point symmetry.

[Clause 8]

The golf club head according to any one of clauses 1 to 7, wherein each connecting part has an axis line that passes through a center of gravity of the connecting part and satisfies a sameness of cross sections.

[Clause 9]

The golf club head according to clause 8, wherein each connecting part has a length measured along the axis line of 20% or greater of a length of the face part that is measured along the same axis line.

The above description is merely illustrative and various modifications can be made without departing from the principles of the present disclosure.

What is claimed is:

1. A golf club head comprising:

a head body;

a face part located apart from the head body; and a plurality of connecting parts that extend between the head body and the face part, wherein each connecting part includes an inclination portion that extends while inclining with respect to a face perpendicular direction, and the inclination portion includes an arc inclination portion that extends along a circular arc.

2. The golf club head according to claim 1, wherein each connecting part has a cross section that substantially has a symmetry.

3. The golf club head according to claim 2, wherein the symmetry is a line symmetry.

4. The golf club head according to claim 2, wherein the symmetry is a point symmetry.

5. The golf club head according to claim 1, wherein the face part is connected to the head body by only the connecting parts.

6. The golf club head according to claim 5, wherein the head body includes a front portion, the front portion includes a front face, the face part includes a striking face and a face rear surface, the face rear surface is opposed to the front face of the front portion, and the connecting parts connect the face rear surface and the front face.

7. The golf club head according to claim 1, wherein when the golf club head is in a reference state in which the golf club head is placed on a horizontal plane, the inclination portion extends while inclining with respect to the face perpendicular direction in a cross section that is parallel to the horizontal plane.

8. The golf club head according to claim 1, wherein when the golf club head is in a reference state in which the golf club head is placed on a horizontal plane, the inclination portion extends while inclining with respect to the face perpendicular direction in a cross section that is perpendicular to the horizontal plane and parallel to a front-rear direction.

9. The golf club head according to claim 1, wherein each connecting part has a center of gravity and a large number of cross sections taken along a large number of planes that are perpendicular to each of straight lines passing thorough the center of gravity, an overlapping ratio of the cross sections for each straight line is defined as a cross-section overlapping ratio, when the cross-section overlapping ratio for one of the straight lines is 70% or greater, the one straight line is defined as an axis line of the connecting part, when the cross-section overlapping ratios for two or more of the straight lines are 70% or greater, one of the straight lines that has a maximum cross-section overlapping ratio is defined as the axis line of the connecting part, and each connecting part has the axis line.

10. The golf club head according to claim 9, wherein each connecting part has a length measured along the axis line of 20% or greater of a length of the face part measured along the same axis line.

11. A golf club head comprising:

a head body;

a face part located apart from the head body; and a plurality of connecting parts that extend between the head body and the face part, wherein each connecting part includes an inclination portion that extends while inclining with respect to a face perpendicular direction, and the inclination portion includes a first inclination portion and a second inclination portion that are inclined inversely to each other.

12. The golf club head according to claim 11, wherein the inclination portion includes a straight inclination portion that extends along a straight line.

13. The golf club head according to claim 11, wherein each connecting part has a cross section that substantially has a symmetry.

14. The golf club head according to claim 13, wherein the symmetry is a line symmetry.

15. The golf club head according to claim 13, wherein the symmetry is a point symmetry.

16. The golf club head according to claim 11, wherein each connecting part has a center of gravity and a large number of cross sections taken along a large number of planes that are perpendicular to each of straight lines passing thorough the center of gravity, an overlapping ratio of the cross sections for each straight line is defined as a cross-section overlapping ratio, when the cross-section overlapping ratio for one of the straight lines is 70% or greater, the one straight line is defined as an axis line of the connecting part, when the cross-section overlapping ratios for two or more of the straight lines are 70% or greater, one of the straight lines that has a maximum cross-section overlapping ratio is defined as the axis line of the connecting part, and each connecting part has the axis line.

17. The golf club head according to claim 16, wherein each connecting part has a length measured along the axis line of 20% or greater of a length of the face part measured along the same axis line.

18. The golf club head according to claim 11, wherein the face part is connected to the head body by only the connecting parts.

19. A golf club head comprising:

a head body;

a face part located apart from the head body; and a plurality of connecting parts that extend between the head body and the face part, wherein each connecting part includes an inclination portion that extends while inclining with respect to a face perpendicular direction, each connecting part has a center of gravity and a large number of cross sections taken along a large number of planes that are perpendicular to each of straight lines passing thorough the center of gravity, an overlapping ratio of the cross sections for each straight line is defined as a cross-section overlapping ratio, when the cross-section overlapping ratio for one of the straight lines is 70% or greater, the one straight line is defined as an axis line of the connecting part, when the cross-section overlapping ratios for two or more of the straight lines are 70% or greater, one of the straight lines that has a maximum cross-section overlapping ratio is defined as the axis line of the connecting part, and each connecting part has the axis line.

20. The golf club head according to claim 19, wherein each connecting part has a length measured along the axis line of 20% or greater of a length of the face part measured along the same axis line.

* * * * *